US007520943B2

(12) United States Patent
Ishikawa et al.

(10) Patent No.: US 7,520,943 B2
(45) Date of Patent: Apr. 21, 2009

(54) STEEL PLATE AND WELDED STEEL TUBE EXHIBITING LOW YIELD RATIO, HIGH STRENGTH AND HIGH TOUGHNESS

(75) Inventors: Nobuyuki Ishikawa, Chiyoda-ku (JP); Toyohisa Shinmiya, Chiyoda-ku (JP); Shigeru Endo, Chiyoda-ku (JP); Ryuji Muraoka, Chiyoda-ku (JP)

(73) Assignee: JFE Steel Corporation (JP)

( * ) Notice: Subject to any disclaimer, the term of this patent is extended or adjusted under 35 U.S.C. 154(b) by 251 days.

(21) Appl. No.: 10/559,844

(22) PCT Filed: Jun. 10, 2004

(86) PCT No.: PCT/JP2004/008509

§ 371 (c)(1),
(2), (4) Date: Dec. 7, 2005

(87) PCT Pub. No.: WO2004/111286

PCT Pub. Date: Dec. 23, 2004

(65) Prior Publication Data

US 2006/0151074 A1 Jul. 13, 2006

(30) Foreign Application Priority Data

| | | |
|---|---|---|
| Jun. 12, 2003 | (JP) | 2003-167907 |
| Jul. 16, 2003 | (JP) | 2003-198010 |
| Jul. 31, 2003 | (JP) | 2003-204983 |
| Jul. 31, 2003 | (JP) | 2003-204986 |
| Jul. 31, 2003 | (JP) | 2003-204995 |

(51) Int. Cl.
*C22C 38/12* (2006.01)
*C22C 38/14* (2006.01)

(52) U.S. Cl. ..... 148/328; 148/320; 148/330; 148/332; 148/333; 148/334; 148/335; 148/336

(58) Field of Classification Search ..... 148/328, 148/320, 330, 332–336, 593, 654; 420/123–127, 420/109–111
See application file for complete search history.

(56) References Cited

U.S. PATENT DOCUMENTS 5,755,895 A * 5/1998 Tamehiro et al. ..... 148/336

FOREIGN PATENT DOCUMENTS

| | | |
|---|---|---|
| JP | 55-41927 A | 3/1980 |
| JP | 55-97425 A | 7/1980 |
| JP | 62-174322 A | 7/1987 |
| JP | 01-176027 A | 7/1989 |

(Continued)

*Primary Examiner*—Deborah Yee
(74) *Attorney, Agent, or Firm*—DLA Piper LLP (US)

(57) ABSTRACT

A low yield ratio, high toughness steel plate which can be manufactured at high manufacturing efficiency and low cost, without increasing material cost by adding large amount of alloy elements and the like, and without degrading toughness of a welding heat affected zone, a low yield ratio, high strength and high toughness steel pipe using the steel plate, and a method for manufacturing those are provided. Specifically, the steel plate and the steel pipe contain C of 0.03% to 0.1%, Si of 0.01 to 0.5%, Mn of 1.2 to 2.5% and Al of 0.08% or less, wherein a metal structure is a substantially three-phase structure of ferrite, bainite and island martensite, and an area fraction of the island martensite is 3 to 20%, in addition, a complex carbide is precipitated in the ferrite phase.

10 Claims, 7 Drawing Sheets

FOREIGN PATENT DOCUMENTS

| | | | | |
|---|---|---|---|---|
| JP | 08-209287 | | * | 8/1996 |
| JP | 09-165621 | A | | 6/1997 |
| JP | 2002-220634 | A | | 8/2002 |
| JP | 2002-322539 | A | | 11/2002 |
| JP | 2003-13138 | A | | 1/2003 |
| JP | 2004-3014 | A | | 1/2004 |
| JP | 2004-30213 | A | | 1/2004 |
| WO | WO 03/006699 | A1 | | 1/2003 |

* cited by examiner

STEEL PLATE AND WELDED STEEL TUBE EXHIBITING LOW YIELD RATIO, HIGH STRENGTH AND HIGH TOUGHNESS

TECHNICAL FIELD

The present invention relates to a low yield ratio, high strength and high toughness steel plate preferable for use in fields such as architecture, marine structure, line pipe, shipbuilding, civil engineering, and construction machine, and a large-diameter welded steel pipe (UOE steel pipe, and spiral steel pipe) preferable for a line pipe for mainly transporting crude oil or natural gas, which has a property of slight deterioration of quality of material after coating treatment; and relates to a method for manufacturing those.

BACKGROUND ART

Recently, for steel materials for welded structure and the line pipe for mainly transporting the crude oil or the natural gas, in addition to high strength and high toughness, low yield ration is required in the light of earthquake-proof. Generally, it is known that a metal structure of a steel material is formed into a structure in which a hard phase such as bainite or martensite is appropriately dispersed in a soft phase such as ferrite, thereby the low yield ratio of the steel material can be achieved.

As a manufacturing method for obtaining the structure in which the hard phase is appropriately dispersed in the soft phase as above, a heat treatment method where quenching (Q') from a two-phase range of ferrite and austenite ($(\gamma+\alpha)$ temperature range) is performed between quenching (Q) and tempering (T) is known (for example, see JP-A-55-97425). In the heat treatment method, the low yield ratio can be achieved by appropriately selecting the Q' temperature, however, since the number of heat treatment steps increases, reduction in productivity and increase in production cost are caused.

As a method without increasing the number of manufacturing steps, a method is disclosed, in which after rolling has been finished at Ar3 temperature or more, start of accelerated cooling is retarded until the steel material is cooled to the Ar3 transformation point or lower where ferrite formation occurs (for example, see JP-A-55-41927). However, since cooling needs to be performed at a cooling rate of roughly standing to cool in a range from rolling finish to accelerated cooling start, productivity is extremely lowered.

In the welded steel pipe such as UOE steel pipe or electric welded tube used for the line pipe, since a steel plate is formed into a tubular form in cold working, and then abutting surfaces are welded to each other, and then typically coating treatment such as polyethylene coating or powder epoxy coating is applied on an outer surface of the steel pipe in the light of anticorrosion, strain aging occurs due to work strain during pipe production and heating during the coating treatment, thereby yield stress increases. Therefore, even if low yield ratio is achieved in the steel plate as material in the method as above, low yield ratio is hard to be achieved in the steel pipe.

As a steel material having excellent strain aging resistance and a method for manufacturing the material, a method is disclosed, in which content of C and N that cause the strain aging is limited, in addition, Nb and Ti are added and combined with C or N, thereby the strain aging is suppressed (for example, see JP-A-2002-220634).

However, in the technique described in JP-A-2002-220634, as shown in an embodiment of it, since hot rolling finish temperature is low, productivity is extremely lowered, resulting in increase in production cost.

As a technique for achieving the low yield ratio without performing the complicated heat treatment as disclosed in JP-A-55-97425 and JP-A-55-41927, a method is known, in which rolling of a steel material is finished at an Ar3 transformation point or more, and a rate of subsequent accelerated cooling and cooling stop temperature are controlled, thereby a two-phase structure of acicular ferrite and martensite is formed, and thereby the low yield ratio is achieved (for example, see JP-A-1-176027).

However, in the technique described in JP-A-1-176027, as shown in an embodiment of it, since carbon content in the steel material needs to be increased, or other alloy elements need to be added more so that a steel material of tensile strength of 590 N/mm$^2$ (60 kg/mm$^2$) class is formed, deterioration of toughness of a welding heat affected zone is problematic in addition to increase in material cost.

In this way, in the related arts, it is difficult to manufacture the steel pipe having the low yield ratio after coating treatment without reducing productivity, without increasing the material cost, without degrading toughness of the welding heat affected zone, without lowering productivity of the low yield ratio, high strength and high toughness steel plate or steel pipe, and without increasing production cost of the steel pipe.

International Publication WO03/006699 A1, which is a technique previously developed by the inventors of the application, is an invention on a high-strength welded steel pipe having excellent HIC resistance or post-welding toughness by forming a single phase of ferrite in which a complex carbide is finely precipitated. However, since island martensite does not exist in the structure unlike this application, the steel plate having a low yield ratio as an object of the application can not be obtained.

DISCLOSURE OF THE INVENTION

The invention intends to solve the problems of the related arts as above. Thus, the invention intends to provide a low yield ratio, high strength and high toughness steel plate and a low yield ratio, high strength and high toughness steel pipe which can be manufactured efficiently at low cost without increasing the material cost due to adding a large amount of alloy elements and without degrading toughness of the welding heat affected zone, and provide a method for manufacturing those.

To solve the problems, the invention has the following features.

(1) A hot-rolled steel plate contains C of 0.03 to 0.1%, Si of 0.01 to 0.5%, Mn of 1.2 to 2.5% and Al of 0.08% or less by mass, wherein a metal structure is a substantially three-phase structure of ferrite, bainite, and island martensite (M-A constituent) and an area fraction of the island martensite is 3 to 20%, and furthermore, the steel plate has any one of chemical composition conditions of the following (a) to (c) for precipitating the complex carbide in a ferrite phase.

(a) The steel plate further contains Mo of 0.05 to 0.4% and Ti of 0.005 to 0.04%, wherein the remainder is substantially Fe, and C/(Mo+Ti) which is a ratio of C amount to total amount of Mo and Ti in percent by atom is 1.2 to 3.

(b) The steel plate further contains Mo of 0.05 to 0.4% and Ti of 0.005 to 0.04%, in addition, contains Nb of 0.005 to 0.07% and/or V of 0.005 to 0.1%, wherein the remainder is substantially Fe, and C/(Mo+Ti+Nb+V) which is a ratio of C amount to the total amount of Mo, Ti, Nb and V in percent by atom is 1.2 to 3.

(c) The steel plate further contains at least two selected from Ti of 0.005 to 0.04%, Nb of 0.005 to 0.07% and V of 0.005 to 0.1%, wherein the remainder is substantially Fe, and C/(Ti+Nb+V) which is a ratio of the C amount to total amount of Ti, Nb and V in percent by atom is 1.2 to 3.

(2) A hot-rolled steel plate contains C of 0.03 to 0.1%, Si of 0.01 to 0.5%, Mn of 1.2 to 2.5%, Al of 0.08% or less, Mo of 0.05 to 0.4% and Ti of 0.005 to 0.04% by mass, wherein the remainder is substantially Fe, and C/(Mo+Ti) which is a ratio of the C amount to the total amount of Mo and Ti in percent by atom is 1.2 to 3, and a metal structure is substantially a three-phase structure of ferrite, bainite, and island martensite and an area fraction of the island martensite is 3 to 20%.

(3) A hot-rolled steel plate contains C of 0.03 to 0.1%, Si of 0.01 to 0.5%, Mn of 1.2 to 2.5% and Al of 0.08% or less by mass, and contains at least two selected from Ti of 0.005 to 0.04%, Nb of 0.005 to 0.07% and V of 0.005 to 0.1% by mass, wherein the remainder is substantially Fe, and C/(Ti+Nb+V) which is a ratio of the C amount to the total amount of Ti, Nb, and V in percent by atom is 1.2 to 3, and a metal structure is a substantially three-phase structure of ferrite, bainite, and island martensite and an area fraction of the island martensite is 3 to 20%.

(4) In the hot rolled steel plate of (1) to (3), any one of the following complex carbides is precipitated in the ferrite phase;

(a) a complex carbide containing Ti and Mo, having grain diameter of less than 10 nm, (b) a complex carbide containing Ti, Mo, Nb and/or V, having grain diameter of less than 10 nm, or, (c) a complex carbide containing at least two selected from Ti, Nb and V, having grain diameter of less than 10 nm.

(5) In the above (1) to (4), the hot rolled steel plate further contains N of 0.007% or less by mass.

(6) In the above (2), (4) and (5), the hot rolled steel plate further contains Nb of 0.005 to 0.07% and/or V of 0.005 to 0.1% by mass, and C/(Mo+Ti+Nb+V) that is a ratio of the C amount to the total amount of Mo, Ti, Nb and V in percent by atom is 1.2 to 3.

(7) In the above (1) to (6), the hot rolled steel plate contains Ti of 0.005 to less than 0.02%.

(8) In the above (1) to (7), the hot rolled steel plate further contains at least one of Cu of 0.5% or less, Ni of 0.5% or less, Cr of 0.5% or less, B of 0.005% or less, and Ca of 0.0005 to 0.003% by mass.

(9) In the above (1) to (8), the hot rolled steel plate further contains Ti/N of 2 to 8 in percent by mass.

(10) A welded steel pipe uses the steel plates according to the above (1) to (9).

(11) A method for manufacturing a hot-rolled steel plate has a process of hot-rolling a steel slab, which contains C of 0.03 to 0.1%, Si of 0.01 to 0.5%, Mn of 1.2 to 2.5%, and Al of 0.08% or less by mass, and further has any one of chemical composition conditions of the following (a) to (c) to precipitate the complex carbides in the ferrite, at a condition of heating temperature of 1000 to 1300° C. and rolling finish temperature of Ar3 or more; a process of performing accelerated cooling to the hot-rolled steel plate to 450 to 650° C. at a cooling rate of 5° C./sec or more; and a process of reheating the steel plate to 550 to 750° C. at a heating rate of 0.5° C./sec or more promptly after the cooling.

(a) The steel plate further contains Mo of 0.05 to 0.4% and Ti of 0.005 to 0.04%, wherein the remainder is substantially Fe, and C/(Mo+Ti) which is the ratio of the C amount to the total amount of Mo and Ti in percent by atom is 1.2 to 3.

(b) The steel plate further contains Mo of 0.05 to 0.4% and Ti of 0.005 to 0.04%, and contains Nb of 0.005 to 0.07% and/or V of 0.005 to 0.1%, wherein the remainder is substantially Fe, and C/(Mo+Ti+Nb+V) which is the ratio of the C amount to the total amount of Mo, Ti, Nb and V in percent by atom is 1.2 to 3.

(c) The steel plate further contains at least two selected from Ti of 0.005 to 0.04%, Nb of 0.005 to 0.07% and V of 0.005 to 0.1%, wherein the remainder is substantially Fe, and C/(Ti+Nb+V) which is the ratio of the C amount to the total amount of Ti, Nb and V in percent by atom is 1.2 to 3.

(12) In the above (11), a metal structure of the hot-rolled steel plate is the substantially three-phase structure of ferrite, bainite and island martensite, and the area fraction of the island martensite is 3 to 20%.

(13) A method for manufacturing a welded steel pipe has a step of hot-rolling a steel slab, in which C of 0.03 to 0.1%, Si of 0.01 to 0.5%, Mn of 1.2 to 2.5%, Al of 0.08% or less, Mo of 0.05 to 0.4% and Ti of 0.005 to 0.04% by mass are contained, and the remainder is substantially Fe, and C/(Mo+Ti) which is the ratio of the C amount to the total amount of Mo and Ti in percent by atom is 1.2 to 3, at a condition of heating temperature of 1000 to 1300° C. and rolling finish temperature of Ar3 or more; a step of performing the accelerated cooling to the hot-rolled steel plate to 450 to 650° C. at a cooling rate of 5° C./sec or more; a step of reheating the steel plate to 550 to 750° C. at a heating rate of 0.5° C./sec or more promptly after the cooling; and a step of forming a steel plate, in which a metal structure is substantially the three-phase structure of ferrite, bainite, and island martensite, and the area fraction of the island martensite is 3 to 20%, into a tubular shape in cold working, and then welding abutting surfaces to form a steel pipe.

(14) A method for manufacturing a welded steel pipe has a step of hot-rolling a steel slab, in which C of 0.03 to 0.1%, Si of 0.01 to 0.5%, Mn of 1.2 to 2.5%, and Al of 0.08% or less by mass are contained, and at least two selected from Ti of 0.005 to 0.04%, Nb of 0.005 to 0.07%, and V of 0.005 to 0.1% are contained, and the remainder is substantially Fe, and C/(Ti+Nb+V) which is the ratio of the C amount to the total amount of Ti, Nb and V in percent by atom is 1.2 to 3, at a condition of heating temperature of 1000 to 1300° C. and rolling finish temperature of Ar3 or more; a step of performing the accelerated cooling to the hot-rolled steel plate to 450 to 650° C. at a cooling rate of 5° C./sec or more; and a step of reheating the steel plate to 550 to 750° C. at a heating rate of 0.5° C./sec or more promptly after the cooling; and a step of forming a steel plate, in which a metal structure is substantially the three-phase structure of ferrite, bainite, and island martensite, and the area fraction of the island martensite is 3 to 20%, into a tubular shape in cold working, and then welding abutting surfaces to form a steel pipe.

(15) In the method for manufacturing the hot-rolled steel plate or the welded steel pipe in the above (11) to (14), when the steel plate or steel pipe is reheated, it is reheated to temperature at least 50° C. higher than previously cooled temperature after the cooling.

(16) In the above (11) to (15) the method for manufacturing the hot-rolled steel plate or the welded steel pipe, has a process of performing the accelerated cooling to the hot-rolled steel plate to 450 to 650° C. at the cooling rate of 5° C./sec or more to form a two-phase structure of non-transformed austenite and bainite; and a process of reheating the steel plate to 550 to 750° C. at the heating rate of 0.5° C./sec or more promptly after the cooling to change the structure into a three-phase structure of bainite and island martensite and ferrite having precipitates dispersedly precipitated therein.

(17) In the method for manufacturing the hot-rolled steel plate or the welded steel pipe in the above (11) to (16), the treatment of reheating the steel plate to 550 to 750° C. at the heating rate of 0.5° C./sec or more promptly after the cooling is performed with an induction heating device arranged on the same line as rolling equipment and cooling equipment.

(18) In the method for manufacturing the hot-rolled steel plate or the welded steel pipe in the above (11) to (17), any one of the following complex carbides is precipitated in the ferrite;

(a) a complex carbide containing Ti and Mo, having grain diameter of less than 10 nm, (b) a complex carbide containing Ti, Mo, Nb and/or V, having grain diameter of less than 10 nm, or, (c) a complex carbide containing at least two selected from Ti, Nb and V, having grain diameter of less than 10 nm.

(19) In the method for manufacturing the hot rolled steel plate or the welded steel pipe in the above (11) to (18), the steel plate further has N of 0.007% or less by mass.

(20) In the method for manufacturing the hot rolled steel plate or the welded steel pipe according to claim 1 in the above (13) and (15) to (19), the steel plate further has Nb of 0.005 to 0.07% and/or V of 0.005 to 0.1%, and C/(Mo+Ti+Nb+V) that is the ratio of the C amount to the total amount of Mo, Ti, Nb and V in percent by atom is 1.2 to 3.

(21) In the method for manufacturing the hot rolled steel plate or the welded steel pipe in the above (11) to (20), the steel plate further has Ti of 0.005 to less than 0.02%.

(22) In the method for manufacturing the hot-rolled steel plate or the welded steel pipe in the above (11) to (21), the steel plate further contains at least one selected from Cu of 0.5% or less, Ni of 0.5% or less, Cr of 0.5% or less, B of 0.005% or less, and Ca of 0.0005 to 0.003% by mass.

(23) In the method for manufacturing the hot-rolled steel plate or the welded steel pipe in the above (11) to (22), the steel plate further contains Ti/N of 2 to 8 in percent by mass.

(24) In the above (11), (12) and (15) to (23), the method for manufacturing the welded steel pipe has a step of forming the obtained steel plates into a tubular shape in cold working, and then welding abutting surfaces to form a steel pipe.

DESCRIPTION OF THE REFERENCE NUMERALS AND SIGNS

Figure 1:
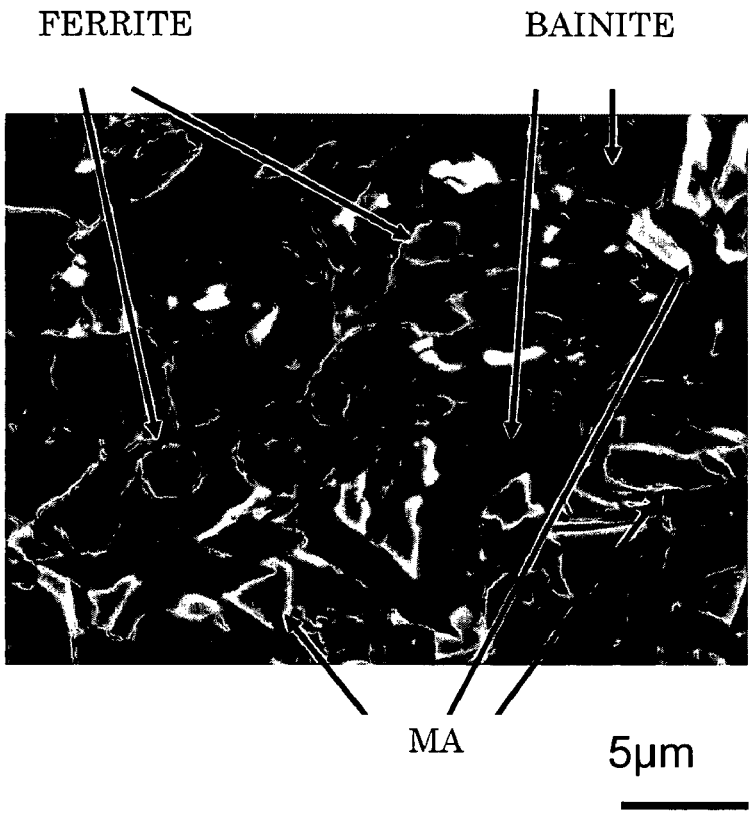
FIG. 1 is a photograph of a steel plate of the invention observed using a scanning electron microscope (SEM)

1: rolling line
2: steel plate
3: hot rolling mill
4: accelerated cooling device
5: heating device
6: hot leveler

BEST MODE FOR CARRYING OUT THE INVENTION

To solve the problems, the inventors have made earnest examination on a method for manufacturing a steel plate (or plate for steel pipe), particularly manufacturing processes of accelerated cooling after controlled rolling and subsequent reheating, as a result the inventors obtained knowledge of the following (a) to (c).

(a) In the process of the accelerated cooling, the cooling is stopped during bainite transformation or in a temperature region where non-transformed austenite exists, and then a steel plate is reheated from the bainite-transformation finish temperature (Bf point) or more, thereby a metal structure of the steel plate is formed into a three-phase structure in which the island martensite as a hard phase (hereinafter, described as MA) is uniformly formed in a mixed phase of ferrite and bainite, and thereby the low yield ratio can be achieved. The MA is stable even after heating of the steel pipe in coating. Here, the MA is white, embossed portions observed in micro-structures as shown in FIGS. 1, 3, 6 and 8 obtained by electrolytic etching after etching using 3% nitral solution (alcohol nitrate solution).

(b) By using the process, in addition to strengthening due to the bainite transformation during the accelerated cooling, precipitation strengthening is obtained due to fine precipitates which precipitate during ferrite transformation from non-transformed austenite in reheating, therefore high strength can be achieved even in a low-component-system steel having a small amount of alloy elements. Moreover, by the precipitation of the fine precipitates, since dissolved C or N causing the strain aging is decreased, increase in yield stress due to strain aging after steel-pipe formation or coating treatment can be suppressed.

Then, by using a steel containing Mo and Ti, dispersed precipitation of an extremely fine complex carbide of Mo and Ti is obtained, and even in the case that Nb and V are mixedly added, a complex carbide containing Ti, Mo and Nb and/or V is dispersedly precipitated, thereby improvement in strength of ferrite can be achieved. Alternatively, by using a steel containing two or more of Ti, Nb and V, an extremely fine complex carbide containing Ti, Nb and V is dispersedly precipitated, thereby improvement in strength of ferrite can be achieved.

(c) The effects in the above (a) and (b) can be obtained by accelerating formation of MA by adding a hardenability improving element such as Mn, and using a steel added with a carbide formation element such as Mo and Ti. Alternatively, the effects can be obtained by using a steel added with a carbide formation element such as Ti, Nb and V.

The invention, which was obtained according to the knowledge, relates to the low yield ratio, high-strength and high-toughness steel plate and the low yield ratio, high strength and high toughness steel pipe having the three-phase structure where the bainite phase formed by the accelerated cooling after rolling, the ferrite phase in which a precipitate essentially containing Ti and Mo or the complex carbide containing two or more of Ti, Nb and V, which is formed by reheating after the cooling, is dispersedly precipitated, and MA as the hard phase are uniformly formed. Furthermore, it relates to a low yield ratio, high strength and high toughness steel pipe having the excellent stress aging resistance.

Hereinafter, a high strength steel plate and a steel plate for high strength steel pipe of the invention are described in detail. First, structures of the high strength steel plate and the steel plate for high strength steel pipe of the invention are described.

In the invention, a structure where MA as the hard phase is uniformly formed in the mixed phase of ferrite and bainite is formed, thereby the low yield ratio is achieved. In addition, fine carbides are precipitated in ferrite to decrease the dissolved C and N, which cause the strain aging, thereby the low yield ratio is achieved in the steel pipe after coating treatment.

Figure 11:
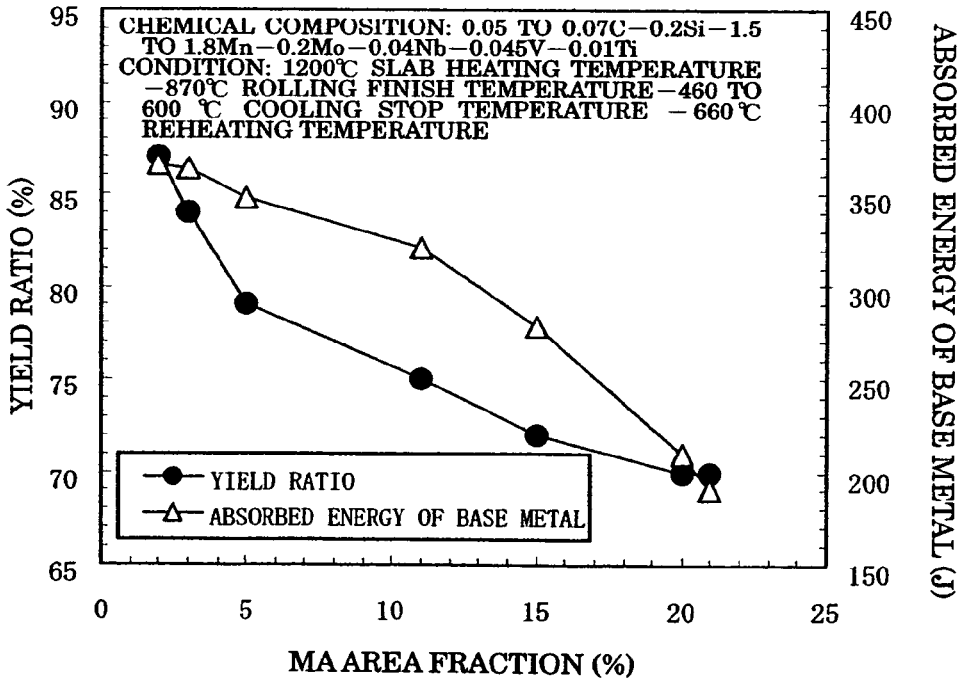
FIG. 11 is a diagram showing a relation between an MA area fraction and a yield ratio, and the fraction and absorbed energy of base metal.

In the invention, a mechanism of MA formation is as follows. After a slab is heated, rolling is finished in an austenite region, and then accelerated cooling is started at the Ar3 transformation temperature or more. In the manufacturing process, the accelerated cooling is finished during the bainite transformation or in a temperature region where the non-transformed austenite exists, and then a steel pipe is reheated at the bainite-transformation finish temperature (Bf point) or more, and then cooled. Change of a structure of the steel plate is as follows. A microstructure at finish of the accelerated cooling comprises bainite and non-transformed austenite, and ferrite transformation from the non-transformed austenite occurs by reheating the steel plate at the Bf point or more, however, since C slightly dissolves in ferrite, it is emitted into the non-transformed austenite. Therefore, C content in the non-transformed austenite increases with progress of the ferrite transformation during reheating. At that time, when a fixed amount or more of Mn, Cu, Ni, which improves the hardenability and are austenite stabilizing elements, are contained, non-transformed austenite having concentrated C therein is remained even at a reheating finish point, which transforms into MA in cooling after reheating, and finally the three-phase structure of bainite, ferrite and MA is formed. In the invention, it is important that after the accelerated cooling, reheating is performed from the temperature region where the non-transformed austenite exists, and when reheating start temperature is the Bf point or less, the bainite transformation is completed and thus the non-transformed austenite does not exists, therefore the reheating needs to be started at the Bf point or more. Although cooling after reheating is not particularly limited because it does not have influence on transformation of MA or coarsening of fine carbides described later, air cooling is essentially preferable. In the invention, the accelerated cooling is stopped during bainite transformation, and then reheating is successively performed, thereby MA as the hard phase can be formed without reducing the manufacturing efficiency, and the three-phase structure as a complex structure including MA is formed, and thereby the low yield ratio can be achieved. A ratio of MA in the three-phase structure is limited to be 3 to 20% in an area fraction of MA (ratio of area of MA in any section of a steel plate, for example, along a rolling direction, plate width direction). FIG. 11 shows a relation between the MA area fraction and the yield ratio, and the fraction and absorbed energy of a base metal. As shown in FIG. 11, an MA area fraction of 3% or less is insufficient for achieving the low yield ratio (yield ratio of 85% or less), and an MA area fraction of more than 20% may cause deterioration (less than 200 J) of the toughness of the base metal. Moreover, as shown in FIG. 11, the MA area fraction is desirably 5 to 15% in the light of further low yield ratio (yield ratio of 80% or less) and securing of the toughness of the base metal. As the MA area fraction, a ratio of area occupied by MA is obtained by performing image processing to a microstructure obtained by SEM observation. Average grain diameter of MA is 10 μm or less. The average grain diameter of MA is obtained by performing image processing to the microstructure obtained by SEM observation, and obtaining diameter of a circle having the same area as individual MA for individual MA, and then averaging the obtained diameters.

To suppress increase in yield stress due to strain aging after steel pipe formation or coating treatment, and achieve the high strength, precipitates of fine complex carbides, which precipitates in ferrite and bainite during reheating after accelerated cooling, is used.

Moreover, to achieve the high strength, transformation strengthening by bainite transformation during accelerated cooling, and precipitation strengthening by precipitation of the fine complex carbide that precipitates in ferrite by reheating after the accelerated cooling are mixedly used, thereby the high strength is achieved without adding a large amount of alloy elements. Although ferrite is highly ductile and typically soft, in the invention, it is highly strengthened by the following precipitation of fine complex carbide. When large amount of alloy elements is not added, strength is insufficient only by bainite single-phase structure obtained by the accelerated cooling, however, a structure having sufficient strength is formed by having precipitation-strengthened ferrite. Although a steel plate using the precipitation strengthening generally has a high yield ratio, in the invention, phases such as ferrite and bainite and MA, which is hard and has large hardness difference compared with the phases, are uniformly formed, thereby the low yield ratio is realized. Furthermore, since the dissolved C and N causing the strain aging is fixed as precipitates of the fine complex carbides, the strain aging after heating in steel pipe formation or coating can be suppressed.

The matter that a metal structure substantially comprises the three-phase structure of ferrite, bainite and island martensite means that a metal structure containing a structure other than ferrite, bainite and MA is incorporated within a scope of the invention, unless it prevents operations and effects of the invention.

When one or at least two of different metal structures such as pearlite are mixed in the three-phase structure of ferrite, bainite and MA, since strength is lowered, a smaller area fraction of the structure other than ferrite, bainite and MA is better. However, when the area fraction of the structure other than ferrite, bainite and MA is small, since influence of the structure can be neglected, one or at least two of other metal structures or pearlite, cementite and the like can be contained at 3% or less in a total area fraction. Moreover, it is desirable that an area fraction of ferrite is 5% or more in the light of securing strength, and an area fraction of bainite is 10% or more in the light of securing toughness of a base metal.

Next, the precipitate of the fine complex carbides that precipitate in ferrite is described.

The steel plate of the invention uses the precipitation strengthening by the complex carbide essentially containing Mo and Ti in ferrite. Alternatively, it uses the precipitation strengthening by the complex carbide containing at least two selected from Ti, Nb and V in ferrite. Moreover, it uses the precipitation strengthening due to the fine complex carbide for improvement in strain aging resistance after steel-pipe formation or heating in coating. Mo and Ti are elements that act to form carbides in steel, and strengthening of the steel by precipitation of MoC or TiC has been traditionally performed. The invention is characterized in that Mo and Ti are mixedly added, and a complex carbide essentially containing Mo and Ti is finely and dispersedly precipitated in the steel, thereby large effects on improvement in strength is obtained compared with the case of strengthening by precipitation of MoC or TiC. The nonconventional, large effects on improvement in strength is due to a fact that since the complex carbide essentially containing Mo and Ti is stable and has a slow grow rate, a precipitate of an extremely fine complex-carbide having average grain diameter of less than 10 nm is obtained. A ratio of the number of the fine precipitate of the complex carbide is preferably 95% or more of the total precipitates except for TiN. The average grain diameter of the precipitate of the fine composite carbide is obtained by performing image processing to a photograph taken with a transmission electron microscope (TEM), and obtaining a diameter of a circle having the same area as individual precipitate for individual complex carbide, and then averaging the obtained diameters.

In the complex carbide essentially containing Mo and Ti, when it comprises only Mo, Ti and C, a total of Mo and Ti is combined with C in an atomic ratio of nearly 1, which is highly effective for improvement in strength. Further, invention found that Nb and/or V are mixedly added, thereby a precipitate of a complex carbide containing Mo, Ti, Nb and/or V was formed, and thereby a similar precipitation strengthening effect was obtained.

Moreover, the invention is characterized in that instead of the composite carbide essentially containing Mo and Ti described above, at least two selected from Ti, Nb and V are mixedly added, thereby a composite carbide containing at least two selected from Ti, Nb and V is finely precipitated in a steel, and thereby a large effect on improvement in strength is obtained compared with a case of precipitation strengthening using an individual carbide. The nonconventional, large effect on improvement in strength is due to a fact that since the complex carbide is stable and has a slow grow rate, a precipitate of an extremely fine complex-carbide having average grain diameter of less than 10 nm is obtained.

In the invention, the complex carbide containing at least two selected from Ti, Nb and V, which is a precipitate of a complex carbide dispersedly precipitating in the steel plate, is a carbide where the total of Ti, Nb and V is combined with C in an atomic ratio of nearly 1, which is extremely effective for improvement in strength. Although the fine carbide precipitates mainly in the ferrite phase, it sometimes precipitates from the bainite phase depending on a chemical composition or manufacturing conditions.

The steel plate of the invention has a complex structure comprising the three-phase of bainite, MA and ferrite in which the precipitate of the complex carbide finely precipitates, and such a structure can be obtained by manufacturing the steel plate according to the following method using a steel having the following composition.

First, a chemical composition of a high strength steel plate (or high strength steel pipe) of the invention is described. In the following description, all units expressed by % indicate percent by mass.

C: 0.03 to 0.1%:

C contributes to precipitation strengthening as carbide, and is an important element for MA formation, however, it is insufficient for the MA formation and can not secure sufficient strength at less than 0.03%. When C of more than 0.1% is added, HAZ toughness is deteriorated. Therefore, C content is limited to be 0.03% to 0.1%. More preferably, it is 0.03% to 0.08%.

Si: 0.01 to 0.5%:

Si, which is added for deoxidization, has not a sufficient deoxidization effect at less than 0.01%, and deteriorates toughness or weldability at more than 0.5%. Therefore, Si content is limited to be 0.01% to 0.5%. More preferably, it is 0.01% to 0.3%.

Figure 12:
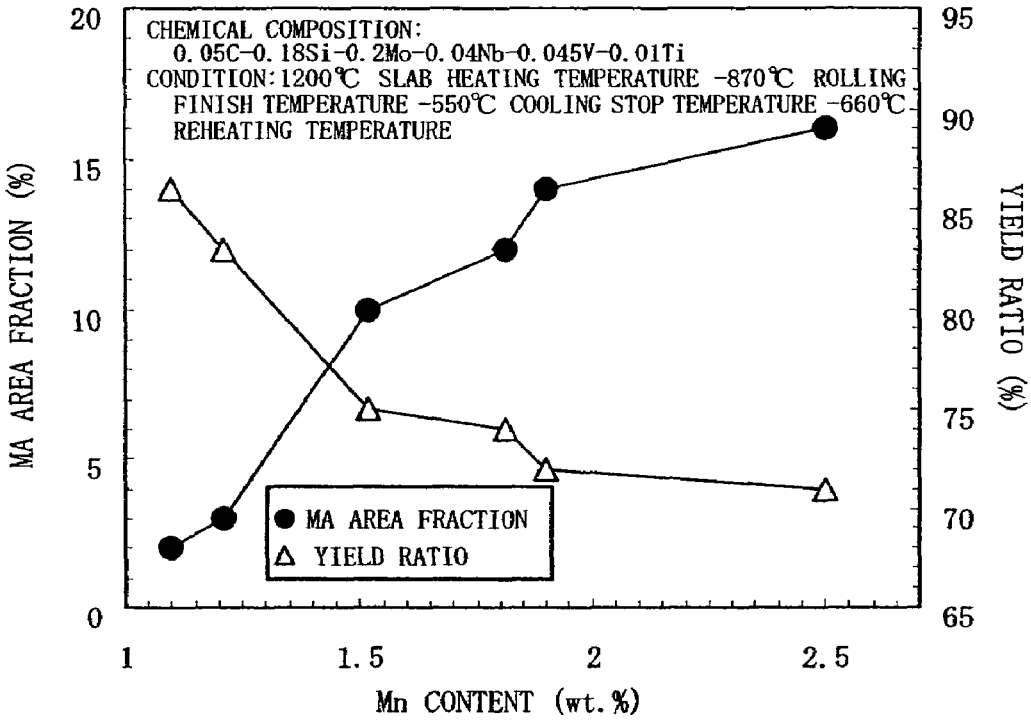
FIG. 12 is a diagram showing between Mn content and the MA area fraction, and the Mn content and the yield ratio.

Mn: 1.2 to 2.5%:

Mn is added for improving strength and toughness, and further improving hardenability to accelerate the MA formation. FIG. 12 shows a relation between Mn content and an MA area fraction, and Mn content and a yield ratio. As shown in FIG. 12, when the Mn content is less than 1.2%, the MA area fraction is less than 3% and the yield ratio is more than 85%. Thus, effects of addition of Mn are insufficient. When the Mn content is more than 2.5%, toughness and weldability are degraded. Therefore, the Mn content is limited to be 1.2 to 2.5%. To achieve stable MA formation and a lower yield ratio (yield ratio of 80% or less) without regard to variation of a component or manufacturing conditions, it is desirable that Mn is added such that the Mn content is 1.5% or more. More desirably, it is more than 1.8%.

Al: 0.08% or Less:

While Al is added as deoxidizer, since it reduces cleanliness of steel and deteriorates toughness at more than 0.08%, Al content is limited to be 0.08% or less. Preferably, it is 0.01 to 0.08%.

Mo: 0.05 to 0.4%:

Mo is an important element in the invention, and it is contained at 0.05% or more, thereby forms a precipitate of a fine complex carbide with Ti with suppressing pearlite transformation during cooling after hot rolling, and thereby significantly contributes to improvement in strength. However, since Mo is one of elements for forming the fine carbide and consumes C, when it exceeds 0.4%, surplus C necessary for MA formation becomes insufficient. Therefore, Mo content is limited to be 0.05 to 0.4%. Furthermore, it is preferable that the Mo content is 0.1 to 0.3% in the light of toughness of the welding heat affected zone.

Ti: 0.005 to 0.04%:

Ti is an important element in the invention as Mo. Ti is added at 0.005% or more, thereby forms a precipitate of the complex carbide with Mo, and thereby significantly contributes to improvement in strength. However, when it is added at more than 0.04%, deterioration of toughness of the welding heat affected zone is caused. Therefore, Ti content is limited to be 0.005 to 0.04%. Furthermore, when the Ti content is less than 0.02%, further excellent toughness is exhibited. Therefore, in the case that strength can be secured by adding Nb and/or V, the Ti content is preferably limited to be 0.005% or more and less than 0.02%.

In the high strength steel plate of the invention, a steel having the above composition is used, thereby the fine precipitates of the complex carbide containing Ti and Mo can be obtained, however, to maximally use the precipitation strengthening with forming MA, a ratio of content of elements forming the carbides needs to be limited as follows.

Ratio of C Amount to Total Amount of Mo and Ti in Percent by Atom, C/(Mo+Ti) is 1.2 to 3.0:

The high strength according to the invention is due to the precipitate containing Ti and Mo. To effectively use the precipitation strengthening by the complex precipitate, a relation between C amount and amount of Mo and Ti as the carbide formation elements is important, and the elements are added in an appropriate balance, thereby a precipitate of a thermally stable, and extremely fine complex carbide can be obtained. To achieve the low yield ratio, C needs to be added excessively compared with C consumed by the complex carbide. At that time, when a value of C/(Mo+Ti), which is a ratio of the C amount to the total amount of Mo and Ti in percent by atom, is less than 1.2, all C is consumed by the precipitate of the fine complex carbide, and MA is not formed, therefore the low yield ratio can not be achieved. When the value of C/(Mo+Ti), which is the ratio of the C amount to the total amount of Mo and Ti in percent by atom, is more than 3.0, C is excessive, and a hardened structure such as island martensite is formed in the welding heat affected zone, causing deterioration of toughness of welding heat affected zone, therefore, the value of C/(Mo+Ti) is limited to be 1.2 to 3.0. When content in percent by mass is used, each symbol of the element is assumed to be content of each element in percent by mass, and a value of (C/12.01)/(Mo/95.9+Ti/47.9) is limited to be 1.2 to 3.0. More preferably, it is 1.4 to 3.0.

N: 0.007% or Less:

Although N is treated as an inevitable impurity, when it is at more than 0.007%, the toughness of the welding heat affected zone deteriorates. Therefore, preferably it is limited to be at 0.007% or less.

Furthermore, the following is given.

Ti/N: 2 to 8:

Ti/N that is a ratio of Ti amount to N amount is optimized, thereby coarsening of austenite in the welding heat affected zone can be suppressed by TiN particles, thereby excellent welding heat affected zone can be obtained. Therefore, preferably Ti/N is limited to be 2 to 8, and more preferably 2 to 5.

Since Nb and/or V form the fine complex carbide with Ti and Mo, the steel plate of the invention may contain Nb and/or V.

Nb: 0.005 to 0.07%:

Nb refines grains of a structure and thus improves toughness, and forms the complex carbide with Ti and Mo, thereby contributes to improvement in strength. However, since it is not effective at less than 0.005%, and degrades toughness of the welding heat affected zone at more than 0.07%, Nb content is limited to be 0.005 to 0.07%.

V: 0.005 to 0.1%:

V forms the complex carbide with Ti and Mo as Nb, thereby contributes to improvement in strength. However, since it is not effective at less than 0.005%, and degrades toughness of the welding heat affected zone at more than 0.1%, V content is limited to be 0.005 to 0.1%.

When Nb and/or V are contained, the following limitation is given.

Ratio of C Amount to Total Amount of Mo, Ti, Nb and V in Percent by Atom, C/(Mo+Ti+Nb+V) is 1.2 to 3.0:

The high strength according to the invention is due to the precipitate of the complex carbide containing Ti and Mo; and when Nb and/or V are contained, complex precipitates containing them (mainly carbide) are formed. At that time, when a value of C/(Mo+Ti+Nb+V), which is expressed by content of each element in percent by atom, is less than 1.2, all C is consumed by the precipitates of the fine complex carbides, and MA is not formed. Therefore, the low yield ratio can not be achieved. When the value is more than 3.0, C is excessive, and a hardened structure such as island martensite is formed in the welding heat affected zone, causing deterioration of toughness of welding heat affected zone, therefore, the value of C/(Mo+Ti+Nb+V) is limited to be 1.2 to 3.0. When content in percent by mass is used, each symbol of the element is assumed to be content of each element in percent by mass, and a value of (C/12.01)/(Mo/95.9+Ti/47.9+Nb/92.91+V/50.94) is limited to be 1.2 to 3.0. More preferably, it is 1.4 to 3.0.

In addition, as a method for forming another fine complex carbide, instead of the fine complex carbide essentially containing Mo and Ti described above, the steel plate of the invention contains at least two selected from Ti, Nb and V with containing Mo as an inevitable impurity level.

Ti: 0.005 to 0.04%:

Ti is an important element in the invention. Ti is added at 0.005% or more, thereby it forms the fine complex carbide with Nb and/or V, thereby significantly contributes to improvement in strength. However, since when Ti is added at more than 0.04%, deterioration of toughness of the welding heat affected zone is caused, Ti content is limited to be 0.005 to 0.04%. Furthermore, when the Ti content is less than 0.02%, further excellent toughness is exhibited. Therefore, the Ti content is preferably limited to be more than 0.005% and less than 0.02%.

Nb: 0.005 to 0.07%:

Nb refines grains of a structure and thus improves toughness, and forms the precipitate of the complex carbide with Ti and/or V, thereby contributes to improvement in strength. However, since it is not effective at less than 0.005%, and degrades toughness of the welding heat affected zone at more than 0.07%, Nb content is limited to be 0.005 to 0.07%.

V: 0.005 to 0.1%:

As Ti and Nb, V forms the precipitate of the complex carbide with Ti and/or Nb, thereby contributes to improvement in strength. However, since it is not effective at less than 0.005%, and degrades toughness of the welding heat affected zone at more than 0.1%, V content is limited to be 0.005 to 0.1%.

Ratio of C Amount to Total Amount of Ti, Nb and V in Percent by Atom, C/(Ti+Nb+V) is 1.2 to 3.0:

The high strength according to the invention is due to the precipitation of the complex carbide containing any two or more of Ti, Nb and V. At that time, when a value of C/(Ti+Nb+V), which is expressed by content of each element in percent by atom, is less than 1.2, all C is consumed by the precipitate of the fine complex carbide, and MA is not formed. Therefore, the low yield ratio can not be achieved. When the value is more than 3.0, C is excessive, and the hardened structure such as island martensite is formed in the welding heat affected zone, causing deterioration of toughness of welding heat affected zone, therefore, the value of C/(Ti+Nb+V) is limited to be 1.2 to 3.0. When content in percent by mass is used, each symbol of the element is assumed to be content of each element in percent by mass, and a value of (C/12.01)/(Ti/47.9+Nb/92.91+V/50.94) is limited to be 1.2 to 3.0. More preferably, it is 1.4 to 3.0.

In the invention, one or at least two of the following Cu, Ni, Cr, B and Ca may be contained for the purpose of further improving the strength and the toughness of steel plate, and improving hardenability to accelerate MA formation.

Cu: 0.5% or Less:

Cu is an element that is effective for improvement in toughness and increase in strength. Although it is preferable that Cu is added at 0.1% or more in order to obtain the effects, if it is added much, weldability deteriorates. Therefore, when it is added, 0.5% is an upper limit.

Ni: 0.5% or Less:

Ni is an element that is effective for improvement in toughness and increase in strength. Although it is preferable that Ni is added at 0.1% or more in order to obtain the effects, if it is added much, it causes disadvantage in cost, and deterioration of toughness of welding heat affected zone. Therefore, when it is added, 0.5% is an upper limit.

Cr: 0.5% or Less:

Cr is an element that is effective for obtaining sufficient strength even at low C as Mn. Although it is preferable that Cr is added at 0.1% or more in order to obtain the effects, if it is added much, it causes deterioration of weldability. Therefore, when it is added, 0.5% is an upper limit.

B: 0.005% or Less:

B is an element that contributes to increase in strength and improvement in toughness of HAZ. Although it is preferable that B is added at 0.0005% or more in order to obtain the effects, if it is added at more than 0.005%, it causes deterioration of weldability. Therefore, when it is added, the amount is limited to be 0.005% or less.

Ca: 0.0005% to 0.003%:

Ca controls form of sulfide-based inclusions and thus improves toughness. At Ca content of 0.0005% or more, the effects appear. At more than 0.003%, the effects saturate, and conversely cleanliness is reduced, and toughness is degraded. Therefore, when it is added, the amount is limited to be 0.0005% to 0.003%.

The remainder other than the above comprises substantially Fe. The matter that the remainder comprises substantially Fe means that steel containing other minor elements in addition to inevitable impurities can be incorporated within the scope of the invention unless it prevents operations and effects of the invention. For example, Mg and REM may be added at 0.02% or less respectively.

Next, a method for manufacturing the high strength steel plate of the invention is described.

In the high strength steel plate of the invention, using a steel having the above composition, hot rolling is performed at heating temperature of 1000 to 1300° C. and rolling finish temperature of Ar3 or more, and then accelerated cooling is performed to 450 to 600° C. at a cooling rate of 5° C./s or more, and after that reheating is promptly performed to 550 to 750° C. at a heating rate of 0.5° C./s or more, thereby a metal structure is formed into the three-phase structure of ferrite, bainite and MA, and the fine complex carbide mainly containing Mo and Ti, or the fine complex carbide containing at least any two of Ti, Nb and V can be dispersedly precipitated in the ferrite phase. Here, temperature including heating temperature, rolling finish temperature, cooling finish temperature and reheating temperature is average temperature of a slab or a steel plate. The average temperature is obtained from calculation using surface temperature of the slab or the steel plate in consideration of parameters such as plate thickness and heat conductivity. The cooling rate is an average cooling rate obtained by dividing temperature difference necessary for cooling the steel plate to the cooling finish temperature of 450 to 600° C. after finish of the hot rolling by time required for the cooling. The heating rate is an average heating rate obtained by dividing temperature difference necessary for reheating the steel plate to the reheating temperature of 550 to 750° C. by time required for the reheating.

Hereinafter, each of manufacturing conditions is described in detail.

Heating Temperature: 1000 to 1300° C.:

When the heating temperature is less than 1000° C., dissolution of the carbide is insufficient and thus the necessary strength and yield ratio can not be obtained, and when it is more than 1300° C., toughness of a base metal deteriorates. Therefore, it is limited to be 1000 to 1300° C.

Rolling Finish Temperature: Ar3 Temperature or More:

When the rolling finish temperature is less than Ar3 temperature, since a rate of subsequent ferrite transformation is reduced, the dispersed precipitation of the fine precipitate is not sufficiently obtained during the ferrite transformation caused by the reheating, thereby strength is lowered. In addition, C concentration into the non-transformed austenite becomes insufficient during reheating and thus MA is not formed. Therefore, the rolling finish temperature is limited to be Ar3 temperature or more.

Cooling at a Cooling Rate of 5° C./s or More Promptly After Finish of Rolling:

When the cooling rate is less than 5° C./sec, since pearlite is formed during cooling, MA is not formed, and strengthening by bainite can not be obtained, therefore sufficient strength can not be obtained. Accordingly, the cooling rate after finish of rolling is limited to be 5° C./sec or more. If the cooling start temperature is the Ar3 temperature or less and ferrite is formed, the dispersed precipitation of the fine precipitates is not obtained during reheating, causing insufficient strength, in addition, the MA formation does not occur. Therefore, the cooling start temperature is limited to be Ar3 temperature or more. For a cooling method at that time, any cooling equipment can be used depending on manufacturing processes. In the invention, the steel plate is overcooled to a bainite transformation region by the accelerated cooling, thereby the ferrite transformation can be completed without keeping the reheating temperature in subsequent reheating.

Figure 13:
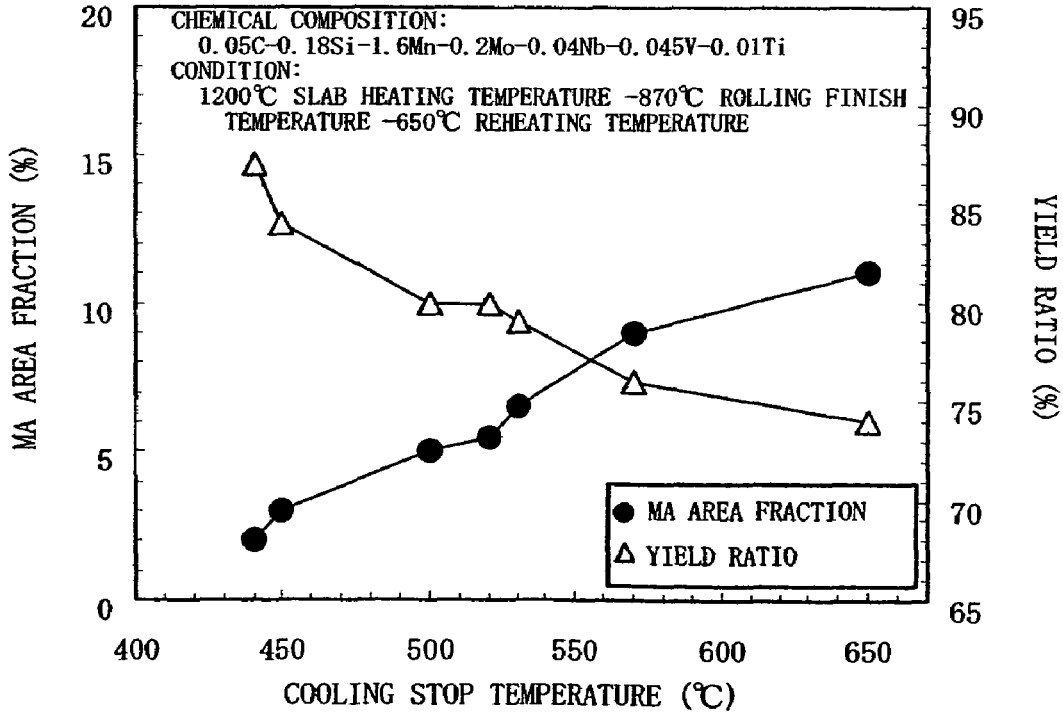
FIG. 13 is a diagram showing a relation between cooling stop temperature and the MA area fraction, and the temperature and the yield ratio.

Cooling Stop Temperature: 450 to 650° C.:

The process is an important manufacturing condition in the invention. In the invention, the non-transformed austenite into which C remained after reheating has been concentrated, is transformed into MA during subsequent air-cooling. Thus, the cooling needs to be stopped in the temperature region where the non-transformed austenite exists during the bainite transformation. FIG. 13 shows a relation between the cooling stop temperature and the MA area fraction, and the temperature and the yield ratio. As shown in FIG. 13, when the cooling stop temperature is less than 450° C., since the bainite transformation is completed, MA area fraction is less than 3%, during air-cooling therefore the low yield ratio (yield ratio of 85% or less) can not be achieved. When it is more than 650° C., since pearlite precipitates during the cooling, the precipitation of the fine carbide is insufficient and thus sufficient strength can not be obtained, and C is consumed by the pearlite and thus the MA area fraction is decreased. Therefore, the accelerated-cooling stop temperature is limited to be 450 to 650° C. In the light of obtaining a further low yield ratio, the cooling stop temperature is preferably limited to be 500 to 650° C. so that the MA area fraction is more than 5%, and in order to achieve a still further lower yield ratio (yield ratio of 80% or less), more preferably it is 530 to 650° C.

Reheating to 550 to 750° C. at heating rate of 0.5° C./sec or more promptly after stop of accelerated cooling:

This process is also an important manufacturing condition in the invention. The precipitate of the fine complex carbide that contributes to strengthening of ferrite precipitates during reheating. Furthermore, by the ferrite transformation from the non-transformed austenite during reheating, and accompanied emission of C into the non-transformed austenite, the non-transformed austenite with concentrated C is transformed into MA during the air cooling after the reheating. To obtain such a precipitate of the fine complex carbide and MA, the steel plate needs to be reheated to the temperature region of 550 to 700° C. promptly after the accelerated cooling. When the heating rate is less than 0.5° C./sec, since long time is required for heating to target reheating temperature, production efficiency is reduced, and pearlite transformation occurs. Therefore, the dispersed precipitation of the precipitate of the fine complex carbide and MA formation are not obtained, and thus the sufficient strength and the low yield ratio can not be obtained. When the reheating temperature is less than 550° C., since sufficient precipitation driving force is not obtained and an amount of the precipitate of the fine complex carbide is small, sufficient precipitation strengthening is not obtained, resulting in reduction in strain aging resistance after steel pipe formation or coating treatment, and insufficient strength. On the other hand, when it is more than 750° C., the precipitate of the complex carbide is coarsened and sufficient strength is not obtained. Therefore, a temperature range of the reheating is limited to be 550 to 750° C. In the invention, it is important that after accelerated cooling, reheating is performed from the temperature region where the non-transformed austenite exists, and if the reheating start temperature is the Bf point or lower, the bainite transformation is completed and the non-transformed austenite does not exist, therefore the reheating need to be started at the Bf point or higher. To ensure the ferrite transformation, the reheating start temperature is desirably increased 50° C. or more compared with the cooling stop temperature. At reheating temperature, time for keeping temperature needs not be particularly set. When the manufacturing method of the invention is used, a precipitate of a sufficiently fine complex carbide is obtained even if a steel plate is cooled promptly after the reheating, therefore high strength is obtained. However, to secure the precipitate of the sufficiently fine composite carbide, temperature keeping for within 30 minitues can be performed. When the temperature is kept for more than 30 minitues, coarsening of the precipitate of the complex carbide is caused, which sometimes lowers the strength. In addition, since the precipitate of the fine complex carbide is not coarsened irrespective of the cooling rate during the cooling after the reheating, it is preferable that the cooling rate after the reheating is essentially air cooling.

Figure 2:
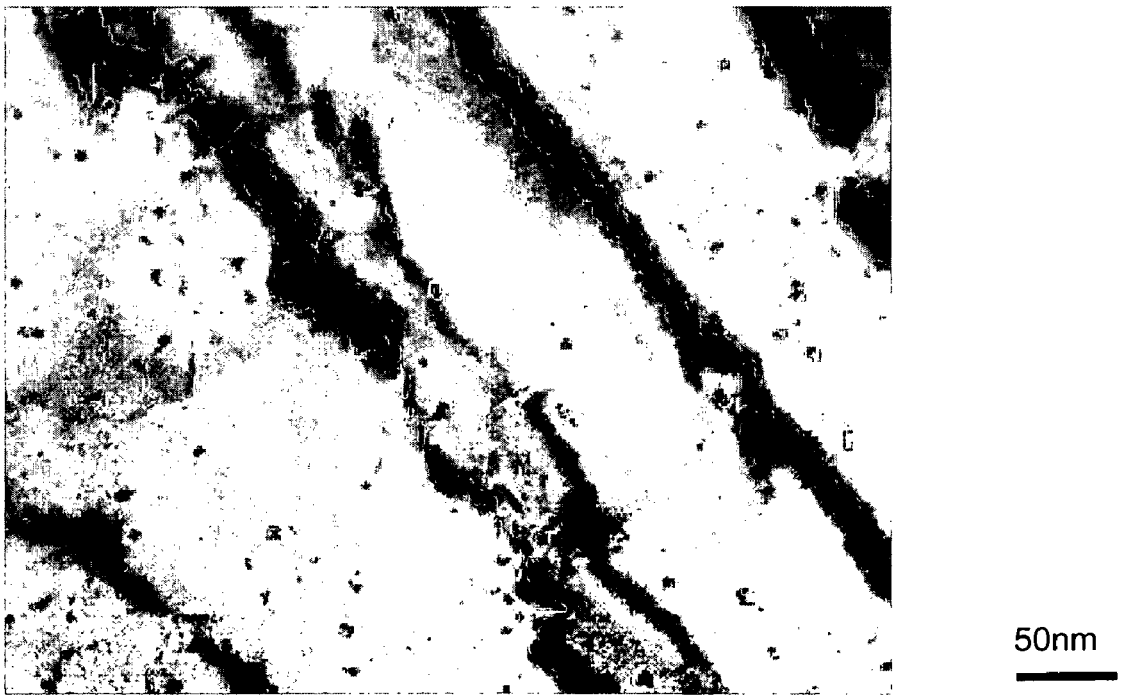
FIG. 2 is a photograph of the steel plate of the invention observed using a transmission electron microscope (TEM)

FIG. 1 and FIG. 2 show a photograph observed with a scanning electron microscope (SEM) and a photograph observed with a transmission electron microscope (TEM) of a steel plate of the invention (0.05 mass % C-1.5 mass % Mn-0.2 mass % Mo-0.01 mass % Ti) manufactured using the above manufacturing method, respectively. From FIG. 1, an aspect that MA is uniformly formed (MA area fraction of 10%) in a mixed structure of ferrite and bainite is observed; and from FIG. 2, a fine complex carbide less than 10 nm in diameter can be confirmed in the ferrite.

Figure 3:
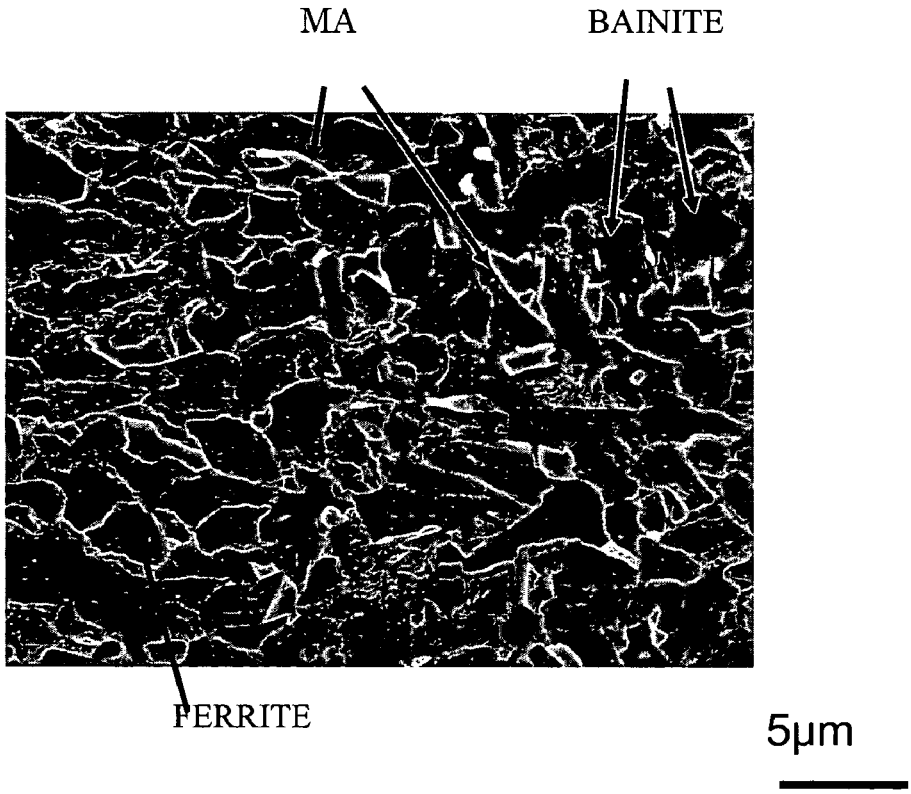
FIG. 3 is a photograph of another steel plate of the invention observed using the scanning electron microscope (SEM)
Figure 4:
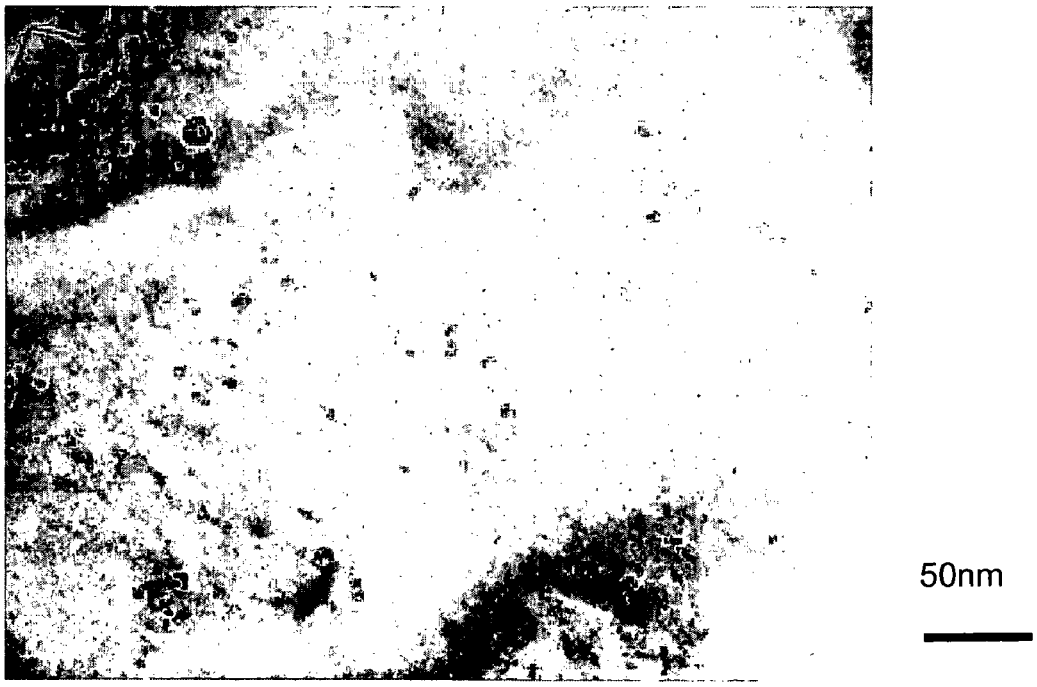
FIG. 4 is a photograph of another steel plate of the invention observed using the transmission electron microscope (TEM)

FIG. 3 and FIG. 4 show a photograph observed with the scanning electron microscope (SEM) and a photograph observed with the transmission electron microscope (TEM) of another steel plate of the invention (0.05 mass % C-1.8 mass % Mn-0.01 mass % Ti-0.04 mass % Nb-0.05 mass % V) manufactured using the above manufacturing method, respectively. From FIG. 3, an aspect that MA is uniformly formed (MA area fraction of 7%) in a mixed structure of ferrite and bainite is observed; and from FIG. 4, a fine complex carbide less than 10 nm in diameter can be confirmed in the ferrite.

As equipment for the reheating after accelerated cooling, a heating device can be arranged at a downstream side of cooling equipment for the accelerated cooling. As the heating device, a gas-fired furnace or an induction heating device, which can rapid heat the steel plate, is preferably used. The induction heating device is particularly preferable because temperature control is easy compared with soaking pit and the like, and a steel plate after cooling can be quickly heated. Moreover, multiple induction heating devices are arranged successively in series, thereby even if line speed or type or size of the steel plate varies, the heating rate and the reheating temperature can be freely controlled only by optionally setting the number of induction heating devices to be applied with electric current.

Figure 5:
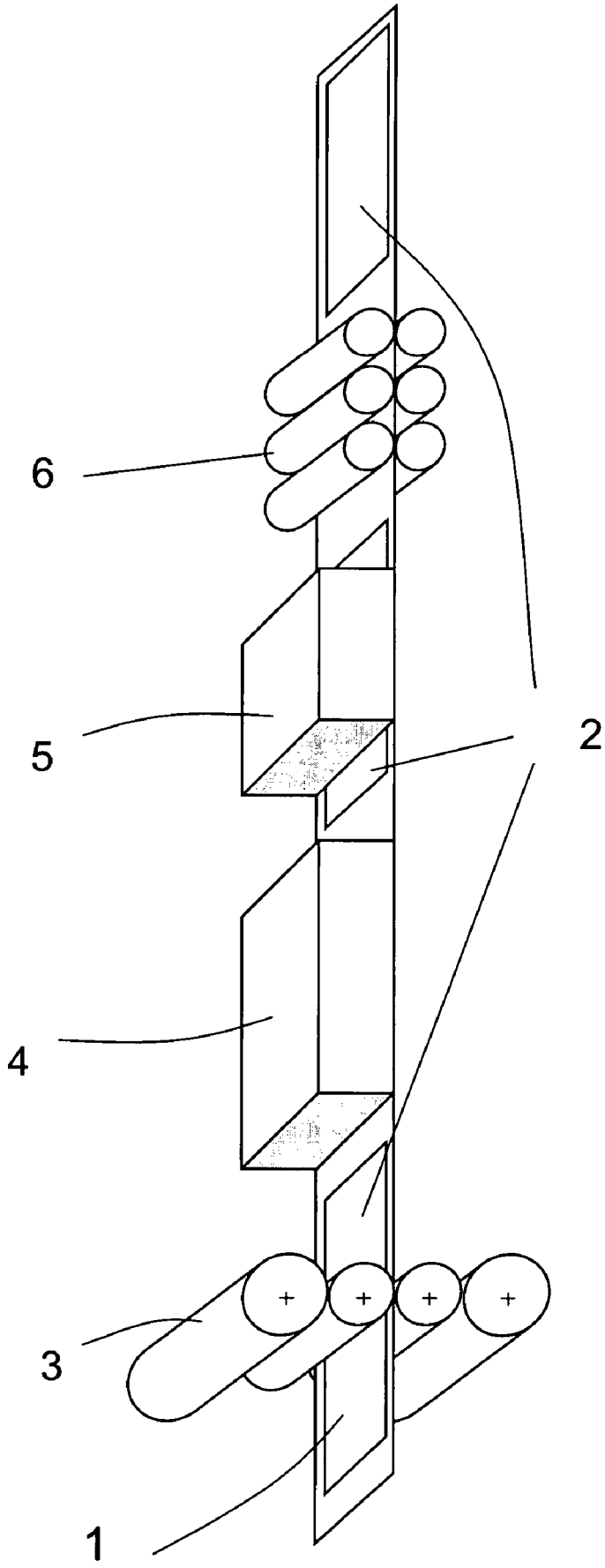
FIG. 5 is a schematic diagram showing an example of a manufacturing line for practicing a manufacturing method of the invention.

An example of equipment for practicing the manufacturing method of the invention is shown in FIG. 5. As shown in FIG. 5, a hot rolling mill 3, an accelerated cooling device 4, a heating device 5, and a hot leveler 6 are arranged on a rolling line 1 from an upstream side to a downstream side. In the heating device 5, the induction heating device or another heat treatment device is arranged on the same line as the hot rolling machine 3 as rolling equipment and the accelerated cooling device 4 as the cooling device subsequent to the machine, thereby the reheating treatment can be performed promptly after the rolling and the cooling were finished. Therefore, the steel plate can be heated without excessively reducing temperature of the steel plate after rolling and cooling.

Furthermore, a method for manufacturing the welded steel pipe is described.

In the welded steel pipe of the invention, the steel plate manufactured at the above manufacturing conditions is formed into a tubular shape in cold working, and then abutting surfaces are welded with, for example, submerged arc welding method to form a steel pipe, and then coating treatment is performed within a temperature range of 300° C. or lower. A method for forming the steel plate into the tubular shape is not particularly limited. For example, the forming is preferably performed using a UOE process or a spiral forming process as the formation method. A coating treatment method is not particularly limited. For example, polyethylene coating or powder epoxy coating is performed. When heating temperature of the steel pipe during the coating is more than 300° C., strain aging resistance may deteriorate or a yield ratio may increase due to MA decomposition, therefore it is limited to be 300° C. or lower.

Figure 6:
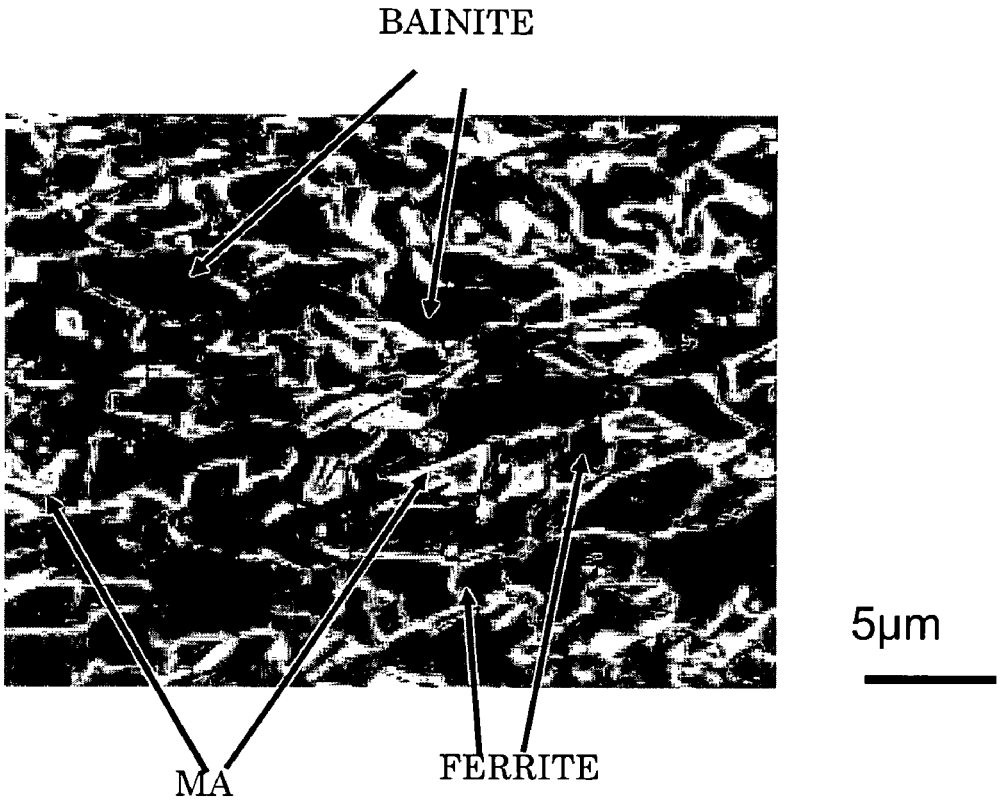
FIG. 6 is a photograph of a steel pipe of the invention observed using a scanning electron microscope (SEM)
Figure 7:
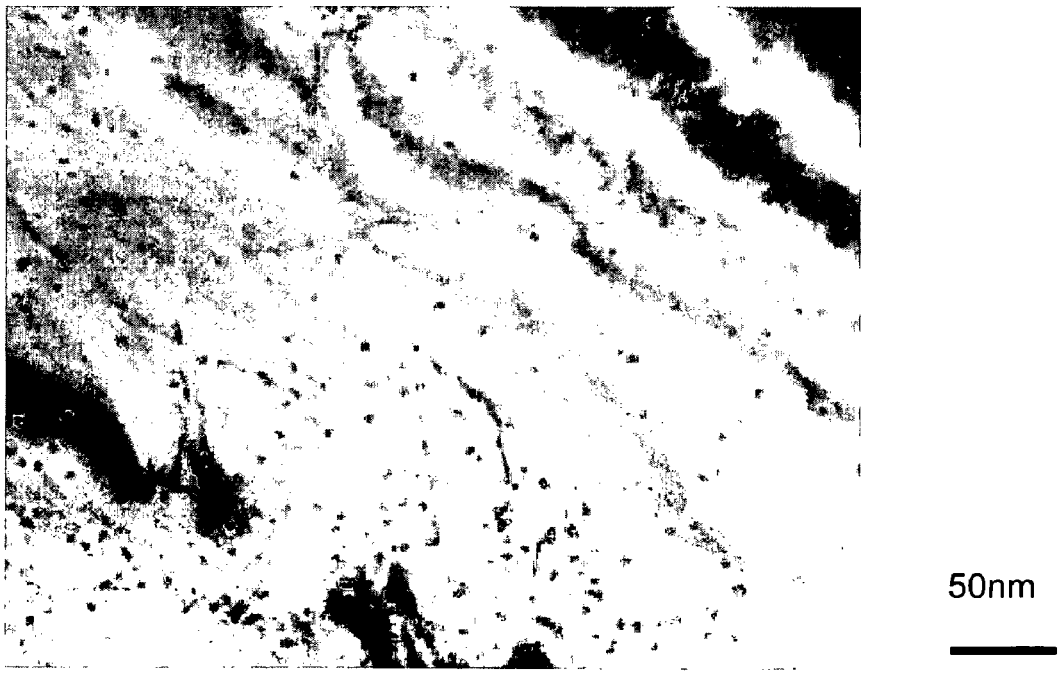
FIG. 7 shows a photograph of the steel pipe of the invention observed using the transmission electron microscope (TEM)

FIG. 6 and FIG. 7 show a photograph observed with the scanning electron microscope (SEM) and a photograph observed with the transmission electron microscope (TEM) of a steel pipe of the invention (0.05% C-1.5% Mn-0.2% Mo-0.01% Ti) manufactured using the above manufacturing method, respectively. From FIG. 6, an aspect that MA is uniformly formed (MA area fraction of 11%) in a mixed structure of ferrite and bainite is observed; and from FIG. 7, a fine complex carbide less than 10 nm in diameter can be confirmed in the ferrite.

Figure 8:
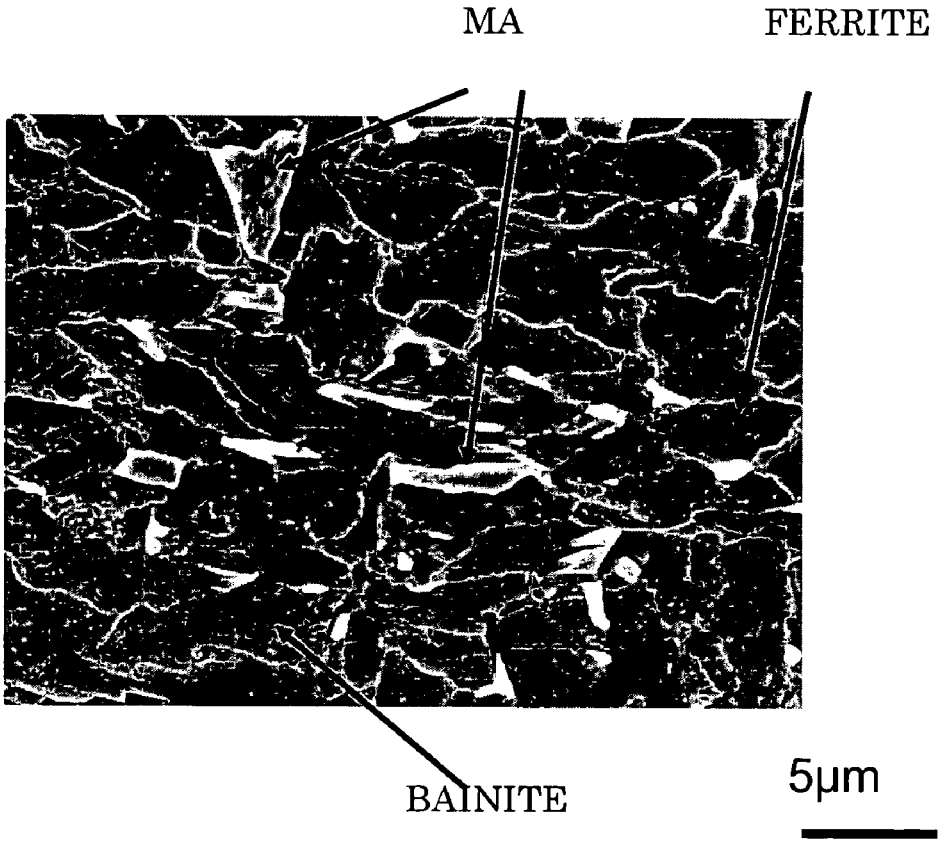
FIG. 8 shows a photograph of another steel pipe of the invention observed using the scanning electron microscope (SEM)
Figure 9:
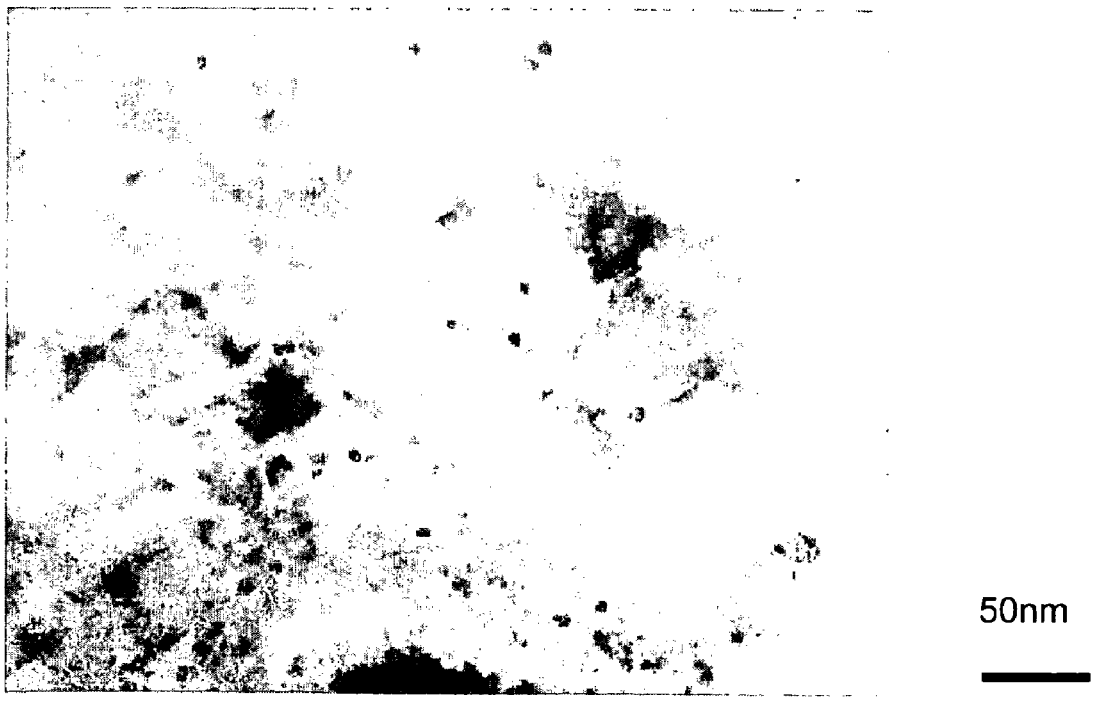
FIG. 9 is a photograph of another steel pipe of the invention observed using the transmission electron microscope (TEM)

FIG. 8 and FIG. 9 show a photograph observed with the scanning electron microscope (SEM) and a photograph observed with the transmission electron microscope (TEM) of a steel pipe of the invention (0.05% C-1.8% Mn-0.01% Ti)

manufactured using the above manufacturing method, respectively. From FIG. 8, an aspect that MA is uniformly formed (MA area fraction of 8%) in a mixed structure of ferrite and bainite is observed; and from FIG. 9, a fine complex carbide less than 10 nm in diameter can be confirmed in the ferrite.

EMBODIMENT

First Embodiment

Steel having chemical compositions as shown in Table 1 (steel type A to P) was formed into slabs with continuous casting, and thick steel plates (No. 1 to 29) having a thickness of 18 or 26 mm were manufactured using the slabs.

The slabs were heated and rolled with hot rolling, and then promptly cooled using water-cooled accelerated cooling equipment, and then subjected to reheating using an induction heating furnace or a gas-fired furnace. The induction heating furnace was arranged on the same line as the accelerated cooling equipment. Manufacturing conditions of respective steel plates (No. 1 to 29) are shown in Table 2. Temperature including heating temperature, rolling finish temperature, cooling finish temperature and reheating temperature is given as average temperature of each steel plate. The average temperature was obtained from calculation using surface temperature of the slabs or the steel plates in consideration of parameters such as plate thickness and heat conductivity. A cooling rate is an average cooling rate which was obtained by dividing temperature difference necessary for cooling the steel plates to cooling finish temperature 450 to 600° C. after finish of the hot rolling by time required for the cooling. A heating rate is an average heating rate which was obtained by dividing temperature difference necessary for reheating the steel plates to the reheating temperature 550 to 750° C. after the cooling by time required for the reheating.

Tensile properties of the steel plates manufactured as above were measured. Measurement results are shown together in Table 2. Regarding the tensile properties, two specimens for a full-thickness tensile test in a direction perpendicular to rolling direction were sampled and subjected to the tensile test, and then tensile properties were measured. Then, evaluation was made using an average value of the two. Tensile strength of 580 MPa or more is determined to be strength necessary for the invention, and a yield ratio of 85% or less is determined to be a yield ratio necessary for the invention. Regarding toughness of a base metal, three specimens for a full-size Charpy V-notch test in a direction perpendicular to rolling direction were sampled and subjected to the Charpy test, and then absorbed energy at −10° C. was measured. Then, an average value of the energy was obtained. A base metal having absorbed energy at −10° C. of 200 J or more was determined to be excellent.

Regarding toughness of a welding heat affected zone (HAZ), three specimens, which had been applied with heat history corresponding to heat input of 40 kJ/cm using simulated heat cycle apparatus, were sampled and subjected to the Charpy test. Then, absorbed energy at −10° C. was measured, and an average value of them was obtained. HAZ having Charpy absorbed energy at −10° C. of 100 J or more was determined to be excellent.

Table 2 shows that in any of No. 1 to 17 which are examples of the invention, chemical compositions and manufacturing conditions are within the scope of the invention, high strength of tensile strength of 580 MPa or more and a low yield ratio of yield ratio of 85% or less (yield ratio of 80% or less at Mn of 1.5% or more) are obtained, and toughness of the base metal and the welding heat affected zone is excellent. Moreover, a structure of the steel plates is a three-phase structure of ferrite, bainite and island martensite, and an area fraction of the island martensite is within a range of 3 to 20%. The area fraction of the island martensite was obtained by performing image processing to a microstructure observed with a scanning electron microscopy (SEM). As a result of transmission electron microscopy observation and analysis with energy dispersive X-ray spectroscopy, dispersed precipitation of fine complex carbides having average grain diameter of less than 10 nm, which contains Ti and Mo and further contains Nb and/or V in some steel plates, were observed in the ferrite phase. The average grain diameter of the fine complex carbides was obtained by performing image processing to a photograph taken with the transmission electron microscopy (TEM), and obtaining diameter of a circle having the same area as area of individual complex carbide for individual complex carbide, and then averaging the obtained diameters.

In No. 18 to 22, although the chemical compositions are within the scope of the invention, the manufacturing conditions are out of the scope of the invention, therefore the structures are a two-phase structure of ferrite and bainite, and the yield ratio is insufficient, more than 85%. In No. 23 to 29, since the chemical compositions are out of the scope of the invention, tensile strength is less than 580 MPa and thus sufficient strength is not obtained, or the yield ratio is more than 85%, or the HAZ toughness is bad, less than 100 J.

Second Embodiment

Steel having chemical compositions as shown in Table 3 (steel type A to I) was formed into slabs with the continuous casting, and thick steel plates (No. 1 to 16) having a thickness of 18 or 26 mm were manufactured using the slabs.

The slabs were heated and rolled with hot rolling, and then promptly cooled using the water-cooled accelerated cooling equipment, and then subjected to reheating using the induction heating furnace or the gas-fired furnace. The induction heating furnace was arranged on the same line as the accelerated cooling equipment. Manufacturing conditions of respective steel plates (No. 1 to 16) are shown in Table 4. The temperature of the steel plates, cooling rate, heating rate, tensile properties, toughness of the base metal, toughness of the welding heat affected zone (HAZ), area fraction of the island martensite, and average grain diameter of the composite carbide are obtained similarly as the first embodiment.

Tensile properties of the steel plates manufactured as above were measured. Measurement results are shown together in Table 4. Regarding the tensile properties, a tensile test was performed using a full-thickness specimen in a direction perpendicular to rolling direction as a tensile test piece, and then tensile strength was measured. Tensile strength of 580 MPa or more is determined to be strength necessary for the invention, and a yield ratio of 85% or less is determined to be a yield ratio necessary for the invention. Regarding toughness of the base metal, the Charpy test was performed using a full-size Charpy V-notch specimen in a direction perpendicular to rolling direction. A base metal having absorbed energy at −10° C. of 200 J or more was determined to be excellent.

Regarding the toughness of the welding heat affected zone (HAZ), the Charpy test was performed using a specimen, which had been applied with the heat history corresponding to the heat input of 40 kJ/cm using the simulated heat cycle apparatus. HAZ having the absorbed Charpy energy at −10° C. of 100 J or more was determined to be excellent.

Table 4 shows that in any of Nos. 1 to 7 which are examples of the invention, the chemical compositions and the manufacturing conditions are within the scope of the invention, high strength of tensile strength of 580 MPa or more and a low yield ratio of yield ratio of 85% or less (yield ratio of 80% or less at Mn of 1.5% or more) are exhibited, and toughness of the base metal and the welding heat affected zone is excellent. Moreover, a structure of the steel plates is the three-phase structure of ferrite, bainite and island martensite, and an area fraction of the island martensite is within a range of 3 to 20%. As a result of transmission electron microscopy observation and analysis with energy dispersive X-ray spectroscopy, dispersed precipitation of fine complex carbides having average grain diameter of less than 10 nm, which contains at least two selected from Ti, Nb and V, were observed in the ferrite phase.

In Nos. 8 to 12, although the chemical compositions are within the scope of the invention, the manufacturing conditions are out of the scope of the invention, therefore the structures are the two-phase structure of ferrite and bainite, and the yield ratio is insufficient, more than 85%. In Nos. 13 to 16, since the chemical compositions are out of the scope of the invention, tensile strength is less than 580 MPa and thus sufficient strength is not obtained, or the yield ratio is more than 85%, or the HAZ toughness is bad, less than 100 J.

Third Embodiment

Steel having chemical compositions as shown in Table 5 (steel type A to I) was formed into slabs with the continuous casting, and welded steel pipes (Nos. 1 to 16) having a thickness of 18 or 26 mm and outer diameter of 24 or 48 inches were manufactured using the slabs.

The slabs were heated and rolled with hot rolling, and then promptly cooled using the water-cooled accelerated cooling equipment, and then subjected to reheating using the induction heating furnace or the gas-fired furnace, and thus steel plates were formed. Welded steel pipes were manufactured using the steel plates in a UOE process, and then coating treatment was applied to outer surfaces of the steel pipes. The induction heating furnace was arranged on the same line as the accelerated cooling equipment. Manufacturing conditions of respective steel pipes (Nos. 1 to 16) are shown in Table 6. Measurement of the temperature of the steel plates, cooling rate, heating rate, tensile properties, toughness of the base metal, area fraction of the island martensite, and average grain diameter of the composite carbide were performed similarly as the first embodiment.

Tensile properties of the steel pipes manufactured as above were measured. Measurement results are shown together in Table 6. Regarding the tensile properties, a tensile test was performed using a full-thickness specimen in a rolling direction as a tensile test piece before and after the coating, and tensile strength and a yield ratio were measured. Regarding toughness of the base metal, the Charpy test was performed using a full-size Charpy V-notch specimen in a direction perpendicular to rolling direction, and absorbed energy at −10° C. was measured.

Figure 10:
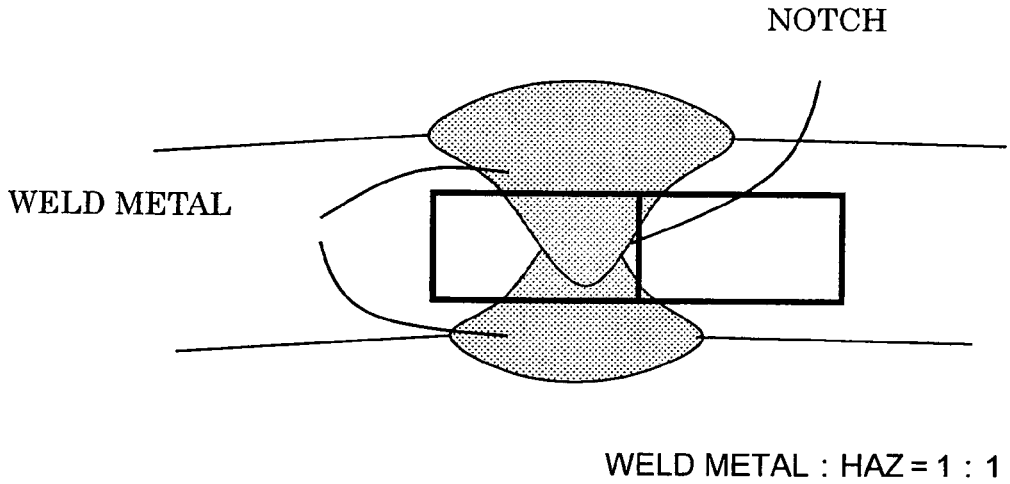
FIG. 10 is a view showing a sampling position of a full-size Charpy V-notch specimen from seam weld portion.

Regarding toughness of the welding heat affected zone (HAZ), three full-size Charpy V-notch specimens were sampled from the center of a seam weld portion along thickness such that a ratio of notch length in weld metal to that in HAZ is 1 as shown in FIG. 10, and then the specimens were subjected to a test, and absorbed Charpy energy at −10° C. was measured and an average value of the three was obtained.

Table 6 shows that in any of Nos. 1 to 9 which are examples of the invention, the chemical compositions and the manufacturing conditions are within the scope of the invention, high strength of tensile strength of 580 MPa or more and low yield ratio of yield ratio of 85% or less even after the coating treatment are exhibited, in addition, toughness of the base metal and the welding heat affected zone is excellent. Moreover, structures of the steel plates were the three-phase structure of ferrite, bainite and island martensite, and an area fraction of the island martensite was within a range of 3 to 20%. As a result of transmission electron microscopy observation and analysis with energy dispersive X-ray spectroscopy, dispersed precipitation of fine complex carbides having average grain diameter of less than 10 nm, which contained Ti and Mo, and further contained Nb and/or V in some steel plates, were observed in the ferrite phase.

In Nos. 10 to 12, although chemical compositions are within the scope of the invention, manufacturing conditions are out of the scope of the invention, therefore, tensile strength is less than 580 MPa, and a yield ratio after coating treatment is more than 85%. Thus, both the strength and the yield ratio were insufficient. In Nos. 13 to 16, since the chemical compositions are out of the scope of the invention, tensile strength is less than 580 MPa and thus sufficient strength is not obtained, or the yield ratio after coating treatment is more than 85%, or the HAZ toughness is bad, less than 100 J.

Forth Embodiment

Steel having chemical compositions as shown in Table 7 (steel type A to I) was formed into slabs with the continuous casting, and welded steel pipes (Nos. 1 to 14) having a thickness of 18 or 26 mm and outer diameter of 24 or 48 inches were manufactured using the slabs.

The slabs were heated and rolled with hot rolling, and then promptly cooled using the water-cooled accelerated cooling equipment, and then subjected to reheating using the induction heating furnace or the gas-fired furnace, and thus steel plates were formed. Welded steel pipes were manufactured using the steel plates in a UOE process, and then coating treatment was applied to outer surfaces of the steel pipes. The induction heating furnace was arranged on the same line as the accelerated cooling equipment. Manufacturing conditions of respective steel pipes (Nos. 1 to 14) are shown in Table 8. Measurement of the temperature of the steel plates, cooling rate, heating rate, tensile properties, toughness of the base metal, area fraction of the island martensite, and average grain diameter of the composite carbide were performed similarly as the first embodiment. Measurement of toughness of the heat affected zone (HAZ) was performed similarly as the third embodiment.

Tensile properties of the steel pipes manufactured as above were measured. Measurement results are shown together in Table 8. Regarding the tensile properties, a tensile test was performed using a full-thickness specimen in a rolling direction as a tensile test piece before and after the coating, and tensile strength and a yield ratio were measured. Regarding toughness of the base metal, the Charpy test was performed using a full-size Charpy V-notch specimen in a direction perpendicular to rolling direction, and absorbed energy at −10° C. was measured.

Regarding toughness of the welding heat affected zone (HAZ), a full-size Charpy V-notch specimen was sampled from the center of a seam weld portion along thickness and subjected to a test, and absorbed Charpy energy at −10° C. was measured.

Table 8 shows that in any of Nos. 1 to 7 which are examples of the invention, the chemical compositions and the manufacturing conditions are within the scope of the invention, high strength of tensile strength of 580 MPa or more and low yield ratio of yield ratio of 85% or less even after the coating treatment are exhibited, and toughness of the base metal and the welding heat affected zone is excellent. Moreover, structures of the steel plates are the three-phase structure of ferrite, bainite and island martensite, and an area fraction of the island martensite is within a range of 3 to 20%. As a result of transmission electron microscopy observation and analysis with energy dispersive X-ray spectroscopy, dispersed precipitation of fine complex carbides having average grain diameter of less than 10 nm, which contained at least two selected from Ti, Nb and V, were observed in the ferrite phase.

In Nos. 8 to 10, although chemical compositions are within the scope of the invention, manufacturing conditions are out of the scope of the invention, therefore, tensile strength is less than 580 MPa, and a yield ratio after coating treatment is more than 85%. Thus, both the strength and the yield ratio were insufficient. In Nos. 11 to 14, since the chemical compositions are out of the scope of the invention, the tensile strength is less than 580 MPa and thus sufficient strength is not obtained, or yield ratio after coating treatment is more than 85%, or HAZ toughness is bad, less than 100 J.

INDUSTRIAL APPLICABILITY

As described hereinbefore, according to the invention, the low yield ratio, high strength and high toughness, thick steel plate can be manufactured at low cost without degrading toughness of the welding heat affected zone, and without adding large amount of alloy elements. Therefore, steel plates for use in welding structures such as architecture, marine structure, line pipe, shipbuilding, civil engineering and construction machine can be manufactured inexpensively, largely and stably, consequently productivity and economics can be extremely improved. In addition, the steel plates obtained as the above is formed to be tubular, and abutting surfaces are welded, thereby the low yield ratio, high strength and high toughness steel pipe can be manufactured at high manufacturing efficiency and low cost. Therefore, steel pipes for use in the line pipe can be manufactured inexpensively, largely and stably, consequently productivity and economics can be extremely improved.

TABLE 1

| Steel | (mass %) | | | | | | | | | | |
|---|---|---|---|---|---|---|---|---|---|---|---|
| type | C | Si | Mn | Mo | Ti | Al | Nb | V | Cu | Ni | Cr |
| A | 0.051 | 0.18 | 1.55 | 0.20 | 0.019 | 0.038 | 0 | 0 | 0 | 0 | 0 |
| B | 0.058 | 0.22 | 1.61 | 0.12 | 0.023 | 0.036 | 0 | 0.049 | 0 | 0 | 0 |
| C | 0.045 | 0.19 | 1.76 | 0.15 | 0.015 | 0.032 | 0.045 | 0 | 0 | 0 | 0 |
| D | 0.055 | 0.21 | 1.52 | 0.19 | 0.011 | 0.035 | 0.030 | 0.031 | 0 | 0 | 0 |
| E | 0.052 | 0.18 | 1.50 | 0.11 | 0.011 | 0.031 | 0.041 | 0.035 | 0 | 0 | 0 |
| F | 0.058 | 0.21 | 1.81 | 0.19 | 0.010 | 0.031 | 0.036 | 0 | 0.31 | 0.29 | 0 |
| G | 0.041 | 0.22 | 1.65 | 0.12 | 0.009 | 0.032 | 0.041 | 0.044 | 0 | 0 | 0.15 |
| H | 0.061 | 0.15 | 1.52 | 0.21 | 0.013 | 0.031 | 0.016 | 0.038 | 0 | 0 | 0 |
| I | 0.085 | 0.19 | 1.89 | 0.21 | 0.018 | 0.028 | 0.039 | 0.048 | 0 | 0 | 0 |
| J | 0.051 | 0.15 | 1.61 | 0.07 | 0.011 | 0.024 | 0.042 | 0.025 | 0 | 0 | 0 |
| K | 0.042 | 0.16 | 1.52 | 0.21 | 0.069 | 0.033 | 0 | 0 | 0 | 0 | 0 |
| L | 0.051 | 0.24 | 1.45 | 0.23 | 0.001 | 0.031 | 0 | 0.039 | 0 | 0 | 0 |
| M | 0.065 | 0.22 | 1.54 | 0.51 | 0.022 | 0.026 | 0.021 | 0 | 0 | 0 | 0 |
| N | 0.012 | 0.19 | 1.55 | 0.25 | 0.015 | 0.031 | 0.039 | 0.050 | 0.21 | 0.09 | 0.15 |
| O | 0.122 | 0.22 | 1.25 | 0.11 | 0.012 | 0.033 | 0.025 | 0 | 0 | 0 | 0 |
| P | 0.046 | 0.05 | 0.75 | 0.15 | 0.022 | 0.031 | 0.033 | 0.031 | 0 | 0 | 0 |

| Steel | (mass %) | | | | Ar3 | C/(Mo + Ti + Nb + V) | |
|---|---|---|---|---|---|---|---|
| type | B | Ca | N | Ti/N | (□) | (atom % ratio) | Remark |
| A | 0 | 0 | 0.0039 | 4.9 | 754 | 1.71 | Chemical |
| B | 0 | 0 | 0.0049 | 4.7 | 754 | 1.79 | composition |
| C | 0 | 0 | 0.0031 | 4.8 | 743 | 1.59 | within the |
| D | 0 | 0 | 0.0045 | 2.4 | 756 | 1.46 | range of |
| E | 0 | 0 | 0.0042 | 2.6 | 765 | 1.73 | the |
| F | 0 | 0 | 0.0035 | 2.9 | 710 | 1.87 | invention |
| G | 0 | 0 | 0.0025 | 3.6 | 753 | 1.24 | |
| H | 0.0004 | 0 | 0.0029 | 4.5 | 753 | 1.50 | |
| I | 0 | 0 | 0.0026 | 6.9 | 716 | 1.80 | |
| J | 0 | 0.0019 | 0.0031 | 3.5 | 760 | 2.23 | |
| K | 0 | 0 | 0.0024 | 28.8 | 759 | 0.96 | Chemical |
| L | 0 | 0 | 0.0031 | 0.3 | 760 | 1.33 | composition |
| M | 0 | 0 | 0.0018 | 12.2 | 726 | 0.90 | outside the |
| N | 0 | 0 | 0.0018 | 8.3 | 751 | 0.23 | range of the |
| O | 0.0007 | 0 | 0.0015 | 8.0 | 763 | 6.10 | invention |
| P | 0 | 0.0019 | 0.0039 | 5.6 | 824 | 1.28 | |

*Underline designates outside the range of the invention.

TABLE 2

| No. | Steel type | Thickness (mm) | Heating temperature (° C.) | Rolling finish temperature (° C.) | Cooling rate (° C./s) | Cooling stop temperature (° C.) | Reheating equipment |
|---|---|---|---|---|---|---|---|
| 1 | A | 18 | 1200 | 870 | 35 | 550 | Induction heating furnace |
| 2 | B | 18 | 1200 | 870 | 38 | 540 | Induction heating furnace |
| 3 | C | 18 | 1200 | 870 | 36 | 560 | Induction heating furnace |
| 4 | C | 18 | 1200 | 870 | 29 | 540 | Induction heating furnace |
| 5 | D | 18 | 1200 | 870 | 32 | 550 | Induction heating furnace |
| 6 | D | 18 | 1200 | 870 | 25 | 580 | Gas-fired furnace |

TABLE 2-continued

| | | | | | | | |
|---|---|---|---|---|---|---|---|
| 7 | D | 26 | 1200 | 870 | 26 | 550 | Induction heating furnace |
| 8 | E | 18 | 1200 | 870 | 33 | 570 | Induction heating furnace |
| 9 | E | 18 | 1050 | 870 | 33 | 570 | Induction heating furnace |
| 10 | F | 18 | 1200 | 870 | 29 | 575 | Induction heating furnace |
| 11 | F | 18 | 1100 | 870 | 30 | 580 | Induction heating furnace |
| 12 | G | 18 | 1200 | 870 | 30 | 560 | Induction heating furnace |
| 13 | G | 18 | 1200 | 870 | 32 | 540 | Gas-fired furnace |
| 14 | H | 18 | 1200 | 920 | 37 | 540 | Induction heating furnace |
| 15 | H | 26 | 1200 | 870 | 26 | 535 | Induction heating furnace |
| 16 | I | 18 | 1200 | 870 | 41 | 550 | Induction heating furnace |
| 17 | J | 18 | 1200 | 870 | 39 | 560 | Gas-fired furnace |
| 18 | H | 18 | 970 | 870 | 33 | 500 | Induction heating furnace |
| 19 | H | 18 | 1200 | 700 | 33 | 500 | Induction heating furnace |
| 20 | H | 18 | 1200 | 870 | 1 | 500 | Induction heating furnace |
| 21 | H | 18 | 1200 | 870 | 1 | 350 | Induction heating furnace |
| 22 | H | 18 | 1200 | 870 | 1 | 700 | Gas-fired furnace |
| 23 | K | 26 | 1200 | 870 | 25 | 500 | Induction heating furnace |
| 24 | L | 26 | 1200 | 870 | 24 | 500 | Induction heating furnace |
| 26 | M | 26 | 1200 | 870 | 42 | 510 | Induction heating furnace |
| 27 | N | 26 | 1200 | 870 | 38 | 480 | Induction heating furnace |
| 28 | O | 26 | 1200 | 870 | 35 | 500 | Induction heating furnace |
| 29 | P | 26 | 1200 | 870 | 36 | 500 | Gas-fired furnace |

| No | Reheating rate (° C./s) | Reheating temperature (° C.) | MA area fraction (%) | Tensile strength (MPa) | Yield ratio (%) | Base metal toughness (J) | HAZ toughness (J) | Remark |
|---|---|---|---|---|---|---|---|---|
| 1 | 29 | 620 | 7 | 620 | 75 | 345 | 169 | Example |
| 2 | 25 | 660 | 6 | 648 | 75 | 333 | 160 | |
| 3 | 32 | 650 | 7 | 698 | 75 | 340 | 166 | |
| 4 | 25 | 580 | 6 | 640 | 76 | 342 | 165 | |
| 5 | 30 | 650 | 8 | 691 | 75 | 329 | 171 | |
| 6 | 1.5 | 640 | 8 | 685 | 76 | 328 | 172 | |
| 7 | 21 | 620 | 9 | 642 | 74 | 328 | 173 | |
| 8 | 28 | 650 | 10 | 670 | 74 | 325 | 185 | |
| 9 | 24 | 650 | 8 | 591 | 74 | 354 | 182 | |
| 10 | 21 | 650 | 10 | 719 | 72 | 324 | 170 | |
| 11 | 24 | 660 | 10 | 690 | 72 | 339 | 169 | |
| 12 | 30 | 660 | 8 | 675 | 73 | 334 | 165 | |
| 13 | 1.6 | 650 | 6 | 668 | 75 | 320 | 166 | |
| 14 | 30 | 640 | 7 | 659 | 75 | 345 | 168 | |
| 15 | 26 | 570 | 5 | 629 | 77 | 324 | 165 | |
| 16 | 19 | 640 | 12 | 813 | 72 | 308 | 142 | |
| 17 | 1.2 | 660 | 8 | 668 | 74 | 338 | 166 | |
| 18 | 36 | 600 | 0 | 570 | 87 | 350 | 158 | Comparative |
| 19 | 32 | 640 | 0 | 571 | 85 | 269 | 153 | Example |
| 20 | 30 | 650 | 0 | 565 | 88 | 287 | 155 | |
| 21 | 38 | 660 | 0 | 652 | 88 | 309 | 159 | |
| 22 | 1.6 | 640 | 0 | 570 | 87 | 322 | 166 | |
| 23 | 35 | 650 | 0 | 740 | 91 | 245 | 41 | |
| 24 | 30 | 650 | 4 | 561 | 77 | 334 | 164 | |
| 26 | 32 | 640 | 0 | 710 | 90 | 284 | 74 | |
| 27 | 34 | 640 | 0 | 558 | 92 | 365 | 187 | |
| 28 | 31 | 650 | 6 | 745 | 75 | 254 | 55 | |
| 29 | 1.7 | 650 | 0 | 615 | 89 | 351 | 198 | |

* Underline designates outside the range of the invention.

TABLE 3

| Steel | (mass %) | | | | | | | | | | |
|---|---|---|---|---|---|---|---|---|---|---|---|
| type | C | Si | Mn | Al | Ti | Nb | V | Cu | Ni | Cr | B |
| A | 0.036 | 0.18 | 1.81 | 0.028 | 0.025 | 0.049 | 0 | 0 | 0 | 0 | 0 |
| B | 0.041 | 0.19 | 1.63 | 0.029 | 0 | 0.039 | 0.039 | 0 | 0 | 0 | 0 |
| C | 0.051 | 0.19 | 1.82 | 0.029 | 0.012 | 0.037 | 0.041 | 0 | 0 | 0 | 0 |
| D | 0.047 | 0.21 | 1.52 | 0.025 | 0.011 | 0.041 | 0.035 | 0.25 | 0.26 | 0 | 0 |
| E | 0.061 | 0.15 | 1.52 | 0.031 | 0.021 | 0.030 | 0.051 | 0 | 0 | 0.16 | 0.0004 |
| F | 0.048 | 0.21 | 0.69 | 0.028 | 0.019 | 0.041 | 0.038 | 0 | 0 | 0 | 0 |
| G | 0.020 | 0.25 | 1.32 | 0.026 | 0.011 | 0.025 | 0.026 | 0 | 0 | 0 | 0 |
| H | 0.031 | 0.19 | 1.31 | 0.035 | 0.042 | 0.042 | 0.065 | 0 | 0 | 0 | 0 |
| I | 0.045 | 0.18 | 1.42 | 0.031 | 0.072 | 0.042 | 0.120 | 0 | 0 | 0 | 0 |

TABLE 3-continued

| Steel type | (mass %) Ca | N | Ti/N | Ar3 (° C.) | C/(Mo + Ti + Nb + V) (atom % ratio) | Remark |
|---|---|---|---|---|---|---|
| A | 0 | 0.0042 | 6.0 | 754 | 2.86 | Chemical |
| B | 0 | 0.0018 | 0 | 767 | 2.88 | composition |
| C | 0 | 0.0031 | 3.9 | 749 | 2.92 | within the |
| D | 0.0022 | 0.0032 | 3.4 | 755 | 2.88 | range of the |
| E | 0 | 0.0049 | 4.3 | 767 | 2.88 | invention |
| F | 0 | 0.0035 | 5.4 | 840 | 2.52 | Chemical |
| G | 0 | 0.0032 | 3.4 | 798 | 1.65 | composition out- |
| H | 0 | 0.0055 | 7.6 | 796 | 0.99 | side the range |
| I | 0 | 0.0032 | 22.5 | 782 | 0.87 | of the invention |

*Underline designates outside the range of the invention.

TABLE 4

| No. | Steel type | Thickness (mm) | Heating temperature (° C.) | Rolling finish temperature (° C.) | Cooling rate (° C./s) | Cooling stop Temperature (° C.) | Reheating equipment |
|---|---|---|---|---|---|---|---|
| 1 | A | 18 | 1200 | 870 | 41 | 550 | Induction heating furnace |
| 2 | B | 18 | 1200 | 870 | 38 | 540 | Induction heating furnace |
| 3 | C | 18 | 1200 | 870 | 41 | 560 | Induction heating furnace |
| 4 | C | 26 | 1100 | 870 | 31 | 550 | Induction heating furnace |
| 5 | D | 18 | 1200 | 870 | 44 | 570 | Induction heating furnace |
| 6 | D | 18 | 1050 | 870 | 42 | 560 | Induction heating furnace |
| 7 | E | 18 | 1150 | 870 | 31 | 560 | Gas-fired furnace |
| 8 | D | 18 | 950 | 870 | 45 | 510 | Induction heating furnace |
| 9 | D | 18 | 1200 | 740 | 45 | 500 | Induction heating furnace |
| 10 | D | 18 | 1200 | 870 | 1 | 510 | Induction heating furnace |
| 11 | D | 18 | 1200 | 870 | 1 | 350 | Induction heating furnace |
| 12 | D | 18 | 1200 | 870 | 1 | 680 | Gas-fired furnace |
| 13 | F | 26 | 1200 | 870 | 28 | 480 | Induction heating furnace |
| 14 | G | 26 | 1200 | 870 | 29 | 500 | Induction heating furnace |
| 15 | H | 18 | 1200 | 870 | 40 | 490 | Induction heating furnace |
| 16 | I | 18 | 1200 | 870 | 44 | 500 | Induction heating furnace |

| No. | Reheating rate (° C./s) | Reheating temper-ature (° C.) | MA area fraction (%) | Tensile strength (MPa) | Yield ratio (%) | Base metal tough-ness (J) | HAZ tough-ness (J) | Remark |
|---|---|---|---|---|---|---|---|---|
| 1 | 15 | 655 | 7 | 629 | 76 | 346 | 168 | Example |
| 2 | 32 | 640 | 6 | 645 | 76 | 322 | 159 | |
| 3 | 10 | 650 | 8 | 669 | 74 | 328 | 195 | |
| 4 | 12 | 660 | 8 | 648 | 75 | 339 | 196 | |
| 5 | 16 | 650 | 9 | 658 | 73 | 358 | 201 | |
| 6 | 15 | 660 | 7 | 595 | 75 | 377 | 196 | |
| 7 | 1.2 | 650 | 9 | 689 | 73 | 312 | 169 | |
| 8 | 12 | 610 | 0 | 559 | 89 | 371 | 199 | Compar- |
| 9 | 15 | 640 | 0 | 568 | 86 | 287 | 198 | ative |
| 10 | 11 | 600 | 0 | 575 | 89 | 369 | 202 | Example |
| 11 | 18 | 660 | 0 | 659 | 90 | 320 | 196 | |
| 12 | 1.2 | 690 | 0 | 555 | 87 | 351 | 199 | |
| 13 | 18 | 650 | 0 | 591 | 90 | 355 | 172 | |
| 14 | 19 | 660 | 0 | 512 | 87 | 345 | 183 | |
| 15 | 15 | 620 | 0 | 652 | 88 | 328 | 132 | |
| 16 | 10 | 650 | 0 | 778 | 92 | 288 | 48 | |

* Underline designates outside the range of the invention.

TABLE 5

| Steel type | (mass %) C | Si | Mn | Mo | Ti | Al | Nb | V | Cu | Ni | Cr | B |
|---|---|---|---|---|---|---|---|---|---|---|---|---|
| A | 0.049 | 0.19 | 1.48 | 0.15 | 0.011 | 0.032 | 0.039 | 0.03 | 0 | 0 | 0 | 0 |
| B | 0.049 | 0.18 | 1.79 | 0.11 | 0.010 | 0.028 | 0.035 | 0.035 | 0 | 0 | 0 | 0 |
| C | 0.045 | 0.21 | 1.82 | 0.22 | 0.018 | 0.029 | 0.035 | 0 | 0 | 0 | 0 | 0 |
| D | 0.052 | 0.18 | 1.83 | 0.20 | 0.011 | 0.027 | 0.039 | 0 | 0.29 | 0.28 | 0 | 0 |

TABLE 5-continued

| | | | | | | | | | | | | |
|---|---|---|---|---|---|---|---|---|---|---|---|---|
| E | 0.051 | 0.19 | 1.55 | 0.11 | 0.015 | 0.024 | 0.015 | 0.025 | 0 | 0 | 0.11 | 0.0007 |
| F | 0.120 | 0.25 | 1.52 | 0.21 | 0.012 | 0.033 | 0.025 | 0 | 0 | 0 | 0 | 0 |
| G | 0.015 | 0.21 | 1.45 | 0.11 | 0.011 | 0.026 | 0.035 | 0.036 | 0 | 0 | 0 | 0 |
| H | 0.059 | 0.22 | 0.75 | 0.21 | 0.018 | 0.026 | 0.035 | 0.045 | 0 | 0 | 0 | 0 |
| I | 0.041 | 0.18 | 1.24 | 0.55 | 0.021 | 0.028 | 0.025 | 0.020 | 0.21 | 0.09 | 0 | 0 |

| Steel type | (mass %) Ca | N | Ti/N | Ar3 (° C.) | C/(Mo + Ti + Nb + V) (atom % ratio) | Remark |
|---|---|---|---|---|---|---|
| A | 0 | 0.0035 | 3.1 | 764 | 1.46 | Chemical |
| B | 0 | 0.0026 | 3.8 | 743 | 1.69 | composition with- |
| C | 0 | 0.0049 | 3.7 | 733 | 1.23 | in the range |
| D | 0.0021 | 0.0033 | 3.3 | 710 | 1.58 | of the invention |
| E | 0 | 0.0022 | 6.8 | 760 | 2.01 | |
| F | 0 | 0.0015 | 8.0 | 734 | 3.69 | Chemical |
| G | 0 | 0.0021 | 5.2 | 781 | 0.51 | composition |
| H | 0 | 0.0035 | 5.1 | 815 | 1.28 | outside the range |
| I | 0.0025 | 0.0045 | 4.7 | 745 | 0.50 | of the invention |

* Underline designates outside the range of the invention.

TABLE 6

| No. | Steel type | Thickness (mm) | Heating temperature (° C.) | Rolling finish temperature (° C.) | Cooling rate (° C./s) | Cooling stop temperature (° C.) | Reheating equipment | Reheating rate (° C./s) | Reheating temperature (° C.) | Outer diameter of steel pipe (inch) |
|---|---|---|---|---|---|---|---|---|---|---|
| 1 | A | 18 | 1200 | 870 | 41 | 570 | Induction heating furnace | 10 | 660 | 24 |
| 2 | A | 18 | 1200 | 870 | 44 | 560 | Induction heating furnace | 11 | 650 | 48 |
| 3 | A | 18 | 1050 | 870 | 42 | 550 | Induction heating furnace | 12 | 650 | 48 |
| 4 | B | 18 | 1200 | 870 | 42 | 550 | Induction heating furnace | 15 | 650 | 24 |
| 5 | B | 26 | 1200 | 870 | 27 | 560 | Induction heating furnace | 12 | 650 | 24 |
| 6 | C | 18 | 1200 | 870 | 39 | 560 | Induction heating furnace | 18 | 650 | 48 |
| 7 | C | 18 | 1100 | 870 | 42 | 570 | Gas-fired furnace | 1.2 | 620 | 48 |
| 8 | D | 18 | 1150 | 870 | 38 | 560 | Induction heating furnace | 14 | 650 | 24 |
| 9 | E | 18 | 1200 | 870 | 44 | 570 | Induction heating furnace | 11 | 650 | 24 |
| 10 | A | 18 | 950 | 870 | 42 | 510 | Induction heating furnace | 25 | 650 | 24 |
| 11 | A | 18 | 1100 | 870 | 39 | 450 | Induction heating furnace | 25 | 530 | 24 |
| 12 | A | 18 | 1100 | 870 | 39 | 690 | Induction heating furnace | 19 | 700 | 24 |
| 13 | F | 18 | 1200 | 870 | 42 | 510 | Induction heating furnace | 25 | 630 | 48 |
| 14 | G | 18 | 1200 | 870 | 42 | 480 | Induction heating furnace | 29 | 650 | 48 |
| 15 | H | 18 | 1200 | 870 | 39 | 520 | Induction heating furnace | 28 | 640 | 48 |
| 16 | I | 18 | 1200 | 870 | 44 | 500 | Induction heating furnace | 31 | 650 | 48 |

| No. | Coating temperature (° C.) | MA area fraction (%) | Tensile strength (MPa) | Yield ratio before coating (%) | Yield ratio after coating (%) | Base metal toughness (J) | HAZ toughness (J) | Remark |
|---|---|---|---|---|---|---|---|---|
| 1 | 190 | 9 | 685 | 72 | 79 | 332 | 212 | Example |
| 2 | 270 | 8 | 680 | 73 | 82 | 319 | 213 | |
| 3 | 190 | 7 | 610 | 74 | 80 | 345 | 210 | |
| 4 | 220 | 9 | 715 | 74 | 79 | 311 | 208 | |
| 5 | 220 | 9 | 710 | 72 | 78 | 322 | 206 | |
| 6 | 220 | 6 | 690 | 77 | 84 | 339 | 218 | |
| 7 | 220 | 5 | 661 | 76 | 83 | 341 | 217 | |

TABLE 6-continued

| | | | | | | | | |
|---|---|---|---|---|---|---|---|---|
| 8 | 250 | 9 | 715 | 72 | 80 | 336 | 215 | |
| 9 | 220 | 7 | 619 | 74 | 80 | 315 | 218 | |
| 10 | 250 | 0 | 545 | 88 | 93 | 351 | 212 | Comparative |
| 11 | 250 | 5 | 585 | 78 | 91 | 333 | 210 | Example |
| 12 | 250 | 0 | 575 | 85 | 92 | 345 | 211 | |
| 13 | 220 | 10 | 852 | 73 | 88 | 271 | 48 | |
| 14 | 220 | 0 | 568 | 89 | 93 | 338 | 182 | |
| 15 | 220 | 0 | 612 | 88 | 92 | 342 | 168 | |
| 16 | 220 | 0 | 698 | 85 | 92 | 319 | 47 | |

* Underline designates outside the range of the invention.

TABLE 7

| Steel | (mass %) | | | | | | | | | |
|---|---|---|---|---|---|---|---|---|---|---|
| type | C | Si | Mn | Ti | Al | Nb | V | Cu | Ni | Cr |
| A | 0.035 | 0.21 | 1.82 | 0.025 | 0.026 | 0.049 | 0 | 0 | 0 | 0 |
| B | 0.042 | 0.21 | 1.71 | 0 | 0.028 | 0.038 | 0.04 | 0 | 0 | 0 |
| C | 0.042 | 0.22 | 1.79 | 0.012 | 0.25 | 0.034 | 0.03 | 0 | 0 | 0 |
| D | 0.045 | 0.25 | 1.48 | 0.014 | 0.026 | 0.032 | 0.04 | 0.35 | 0.35 | 0 |
| E | 0.055 | 0.18 | 1.65 | 0.022 | 0.029 | 0.031 | 0.05 | 0 | 0 | 0.15 |
| F | 0.110 | 0.25 | 1.51 | 0.012 | 0.033 | 0.025 | 0.01 | 0 | 0 | 0 |
| G | 0.021 | 0.18 | 1.49 | 0.011 | 0.026 | 0.035 | 0.04 | 0 | 0 | 0 |
| H | 0.049 | 0.17 | 0.57 | 0.010 | 0.026 | 0.032 | 0.05 | 0 | 0 | 0 |
| I | 0.054 | 0.18 | 1.32 | 0.002 | 0.028 | 0.018 | 0.001 | 0.21 | 0.09 | 0 |

| Steel | (mass %) | | | | Ar3 | C/(Mo + Ti + Nb + V) | |
|---|---|---|---|---|---|---|---|
| type | B | Ca | N | Ti/N | (° C.) | (atom % ratio) | Remark |
| A | 0 | 0 | 0.0042 | 6.0 | 754 | 2.78 | Chemical |
| B | 0 | 0 | 0.0035 | 0.0 | 760 | 2.84 | composition |
| C | 0 | 0 | 0.0042 | 2.9 | 754 | 2.85 | within the range |
| D | 0 | 0.0024 | 0.0044 | 3.2 | 751 | 2.83 | of the invention |
| E | 0.0008 | 0 | 0.0039 | 5.6 | 759 | 2.64 | |
| F | 0 | 0 | 0.0022 | 5.5 | 755 | 12.13 | Chemical |
| G | 0 | 0 | 0.0028 | 3.9 | 784 | 1.22 | composition |
| H | 0 | 0 | 0.0015 | 6.7 | 849 | 2.84 | outside the range |
| I | 0 | 0 | 0.0015 | 1.3 | 779 | 17.62 | of the invention |

* Underline designates outside the range of the invention.

TABLE 8

| No. | Steel type | Thickness (mm) | Heating temperature (° C.) | Rolling finish temperature (° C.) | Cooling rate (° C./s) | Cooling stop Temperature (° C.) | Reheating equipment | Reheating rate (° C./s) | Reheating temperature (° C.) |
|---|---|---|---|---|---|---|---|---|---|
| 1 | A | 18 | 1200 | 870 | 39 | 560 | Gas-fired furnace | 1.2 | 650 |
| 2 | B | 18 | 1200 | 870 | 42 | 550 | Induction heating furnace | 11 | 660 |
| 3 | B | 26 | 1200 | 870 | 28 | 540 | Induction heating furnace | 10 | 650 |
| 4 | C | 18 | 1150 | 870 | 39 | 560 | Induction heating furnace | 15 | 650 |
| 5 | D | 18 | 1150 | 870 | 41 | 560 | Induction heating furnace | 12 | 650 |
| 6 | D | 18 | 1050 | 870 | 38 | 550 | Induction heating furnace | 15 | 600 |
| 7 | E | 18 | 1200 | 870 | 30 | 550 | Gas-fired furnace | 1.2 | 650 |
| 8 | D | 18 | 960 | 800 | 33 | 510 | Induction heating furnace | 25 | 650 |
| 9 | D | 18 | 1200 | 870 | 29 | 470 | Induction heating furnace | 30 | 500 |
| 10 | D | 18 | 1200 | 870 | 35 | 700 | Gas-fired furnace | 1.6 | 640 |
| 11 | F | 18 | 1200 | 870 | 38 | 520 | Induction heating furnace | 25 | 600 |
| 12 | G | 18 | 1200 | 870 | 40 | 500 | Induction heating furnace | 29 | 640 |

TABLE 8-continued

| | | | | | | | | | |
|---|---|---|---|---|---|---|---|---|---|
| 13 | H | 18 | 1200 | 870 | 36 | 520 | Induction heating furnace | 28 | 620 |
| 14 | I | 18 | 1200 | 870 | 38 | 500 | Induction heating furnace | 31 | 600 |

| No. | Outer diameter of steel pipe (inch) | Coating temperature (° C.) | MA area fraction (%) | Tensile strength (MPa) | Yield ratio before coating (%) | Yield ratio after coating (%) | Base metal toughness (J) | HAZ toughness (J) | Remark |
|---|---|---|---|---|---|---|---|---|---|
| 1 | 24 | 200 | 7 | 632 | 76 | 81 | 335 | 201 | Example |
| 2 | 24 | 220 | 8 | 657 | 73 | 80 | 315 | 195 | |
| 3 | 24 | 270 | 8 | 648 | 73 | 82 | 308 | 196 | |
| 4 | 24 | 250 | 9 | 675 | 72 | 80 | 340 | 227 | |
| 5 | 48 | 250 | 9 | 659 | 73 | 80 | 346 | 228 | |
| 6 | 48 | 250 | 7 | 602 | 75 | 82 | 341 | 229 | |
| 7 | 24 | 200 | 8 | 688 | 74 | 81 | 309 | 188 | |
| 8 | 24 | 240 | 0 | 539 | 88 | 94 | 340 | 228 | Comparative example |
| 9 | 24 | 240 | 5 | 578 | 78 | 89 | 336 | 226 | |
| 10 | 24 | 240 | 0 | 561 | 90 | 95 | 338 | 228 | |
| 11 | 48 | 250 | 9 | 781 | 72 | 90 | 287 | 52 | |
| 12 | 48 | 250 | 0 | 512 | 88 | 94 | 299 | 175 | |
| 13 | 48 | 250 | 0 | 547 | 87 | 92 | 339 | 172 | |
| 14 | 48 | 250 | 6 | 575 | 76 | 90 | 335 | 89 | |

* Underline designates outside the range of the invention.

The invention claimed is:

1. A hot-rolled steel plate containing C of about 0.03 to about 0.1%, Si of about 0.01 to about 0.5%, Mn of about 1.2 to about 2.5% and Al of about 0.08% or less by mass, wherein a metal structure is a substantially three-phase structure of ferrite, bainite, and island martensite, and an area fraction of the island martensite is about 3 to about 20%, in addition, the steel plate comprises a complex carbide precipitated in the ferrite phase and further comprises either:

(1) Mo of about 0.05 to about 0.4% and Ti of about 0.005 to about 0.04%, wherein the remainder is substantially Fe, and C/(Mo+Ti) which is a ratio of C amount to total amount of Mo and Ti in percent by atom is 1.2 to 3;

(2) Mo of about 0.05 to about 0.4% and Ti of about 0.005 to about 0.04%, in addition, contains Nb of about 0.005 to about 0.07% and/or V of about 0.005 to about 0.1%, wherein the remainder is substantially Fe, and C/(Mo+Ti+Nb+V) which is a ratio of the C amount to total amount of Mo, Ti, Nb and V in percent by atom is 1.2 to 3; and, (3) at least two selected from Ti of about 0.005 to about 0.04%, Nb of about 0.005 to about 0.07% and V of about 0.005 to about 0.1%, wherein the remainder is substantially Fe, and C/(Ti+Nb+V) which is a ratio of the C amount to total amount of Ti, Nb and V in percent by atom is 1.2 to 3.

2. A hot-rolled steel plate containing C of about 0.03 to about 0.1%, Si of about 0.01 to about 0.5%, Mn of about 1.2 to about 2.5%, Al of about 0.08% or less, Mo of about 0.05 to about 0.4% and Ti of about 0.005 to about 0.04% by mass, wherein the remainder is substantially Fe, and C/(Mo+Ti) which is a ratio of C amount to total amount of Mo and Ti in percent by atom is 1.2 to 3, and a metal structure is a substantially three-phase structure of ferrite, bainite, and island martensite and an area fraction of the. island martensite is about 3 to about 20% and further comprises a complex carbide precipitated in the ferrite phase.

3. A hot-rolled steel plate containing C of about 0.03 to about 0.1%, Si of about 0.01 to about 0.5%, Mn of about 1.2 to about 2.5% and Al of about 0.08% or less by mass, and containing at least two elements selected from Ti of about 0.005 to about 0.04%, Nb of about 0.005 to about 0.07% and V of about 0.005 to about 0.1 by mass, wherein the remainder is substantially Fe, and C/(Ti+Nb+V) which is a ratio of C amount to total amount of Ti, Nb, and V in percent by atom is 1.2 to 3, and a metal structure is a substantially three-phase structure of ferrite, bainite, and island martensite and an area fraction of the island martensite is about 3 to about 20% and further comprises a complex carbide precipitated in the ferrite phase.

4. The hot rolled steel plate according to any one of claims 1 to 3, wherein any one of the following complex carbides is precipitated in the ferrite phase:

(a) a complex carbide containing Ti and Mo, having a grain diameter of less than about 10 nm; and (b) a complex carbide containing Ti, Mo, Nb and/or V, having a grain diameter of less than 10 nm; and (c) a complex carbide containing at least two elements selected from Ti, Nb and V, having a grain diameter of less than 10 nm.

5. The hot rolled steel plate according to any one of claims 1 to 3, wherein the steel plate further contains N of about 0.007% or less by mass.

6. The hot rolled steel plate according to claim 2, wherein the steel plate further contains Nb of about 0.005 to about 0.07% and/or V of about 0.005 to about 0.1% by mass, and C/(Mo+Ti+Nb+V) that is the ratio of the C amount to the total amount of Mo, Ti, Nb and V in percent by atom is 1.2 to 3.

7. The hot rolled steel plate according to any one of claims 1 to 3, wherein the steel plate contains Ti of about 0.005 to less than about 0.02%.

8. The hot rolled steel plate according to any one of claims 1 to 3, wherein the steel plate further contains at least one of Cu of about 0.5% or less, Ni of about 0.5% or less, Cr of about 0.5% or less, B of about 0.005% or less, and Ca of about 0.0005 to about 0.003% by mass.

9. The hot rolled steel plate according to any one of claims 1 to 3, wherein the steel plate further contains Ti/N of about 2 to about 8 in percent by mass.

10. A welded steel pipe using the steel plates according to any one of claims 1 to 3.

* * * * *